US010214012B2

(12) United States Patent
Hochi

(10) Patent No.: US 10,214,012 B2
(45) Date of Patent: Feb. 26, 2019

(54) LIQUID EJECTING APPARATUS AND METHOD OF FORMING ADJUSTMENT PATTERN

(71) Applicant: SEIKO EPSON CORPORATION, Tokyo (JP)

(72) Inventor: Hiroya Hochi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/873,628

(22) Filed: Jan. 17, 2018

(65) Prior Publication Data

US 2018/0201015 A1 Jul. 19, 2018

(30) Foreign Application Priority Data

Jan. 18, 2017 (JP) ..... 2017-006463

(51) Int. Cl.

| | |
|---|---|
| ***B41J 2/13*** | (2006.01) |
| ***B41J 2/21*** | (2006.01) |
| ***B41J 2/51*** | (2006.01) |
| ***B41J 29/393*** | (2006.01) |
| ***B41J 2/045*** | (2006.01) |
| ***B41J 2/145*** | (2006.01) |
| ***B41J 19/14*** | (2006.01) |
| *B41J 29/06* | (2006.01) |

(52) U.S. Cl.

CPC ..... *B41J 2/13* (2013.01); *B41J 2/04505* (2013.01); *B41J 2/04526* (2013.01); *B41J 2/04586* (2013.01); *B41J 2/145* (2013.01); *B41J 2/2132* (2013.01); *B41J 2/2135* (2013.01); *B41J 2/512* (2013.01); *B41J 19/145* (2013.01); *B41J 29/06* (2013.01); *B41J 29/393* (2013.01); *B41J 2029/3935* (2013.01)

(58) Field of Classification Search

CPC ..... B41J 2/04505; B41J 2/04526; B41J 2/04586; B41J 2/13; B41J 2/145; B41J 2/2132; B41J 2/2135; B41J 2/512; B41J 19/145; B41J 29/06; B41J 29/393; B41J 2029/3935

See application file for complete search history.

(56) References Cited

U.S. PATENT DOCUMENTS

| | | | | |
|---|---|---|---|---|
| 6,296,977 | B1 * | 10/2001 | Kaise | G03F 7/70241 430/22 |
| 2009/0244145 | A1 * | 10/2009 | Hara | B41J 2/17593 347/14 |
| 2010/0232817 | A1 * | 9/2010 | Miyadera | G03G 15/161 399/40 |
| 2016/0089918 | A1 * | 3/2016 | Yokota | B41J 29/393 347/14 |

FOREIGN PATENT DOCUMENTS

| | | |
|---|---|---|
| JP | 2005-305694 A | 11/2005 |

* cited by examiner

*Primary Examiner* — Anh T. N. Vo
(74) *Attorney, Agent, or Firm* — Foley & Lardner LLP

(57) ABSTRACT

A liquid ejecting apparatus includes a head unit that ejects ink onto a medium, a transport unit that transports the medium, and a control unit that forms an adjustment pattern on the medium, and the control unit forms, as the adjustment pattern, a pattern including a first pattern that is formed in a transport direction, a plurality of scales that are formed in the transport direction, and a second pattern that is formed at a position corresponding to the scales in the transport direction while the position thereof in a main-scanning direction that intersects the transport direction is changed.

8 Claims, 11 Drawing Sheets

LIQUID EJECTING APPARATUS AND METHOD OF FORMING ADJUSTMENT PATTERN

BACKGROUND

1. Technical Field

The present invention relates to a liquid ejecting apparatus and a method of forming an adjustment pattern in the liquid ejecting apparatus.

2. Related Art

In the related art, an ink jet printing apparatus that reciprocates a head for ejecting ink in a main-scanning direction and prints an image on a print member (medium) by bi-directional printing of a going path and a returning path is known (JP-A-2005-305694, for example).

The printing apparatus described in JP-A-2005-305694 has a head that ejects ink while reciprocating in the main-scanning direction and a pattern creating section that creates, on a medium, a test pattern for correcting ink ejection timing of the head. Furthermore, the test pattern includes a plurality of inspection patterns that are formed of pairs of reference pitch patterns (reference patterns) that are formed by ejecting ink at reference timing in printing of the going path and variable pitch patterns (variable patterns) that are formed by ejecting the ink while successively (in stepwise manner) changing a phase with respect to the reference timing in printing in the returning direction. Then, a proper correction value (phase value) of ink ejection timing is acquired by visually comparing the reference patterns and the variable patterns in the respective plurality of inspection patterns.

The printing apparatus described in JP-A-2005-305694 has a problem that since a proper correction value for ink ejection timing is acquired by visually comparing the reference pattern and the variable pattern for each of the plurality of inspection patterns, it is necessary to inspect extra inspection patterns of improper correction values in addition to the inspection patterns of proper correction values, and inspection becomes complicated.

SUMMARY

The invention can be realized in the following aspects or as application examples.

Application Example 1

According to Application Example 1, there is provided a liquid ejecting apparatus including: an ejecting unit that ejects liquid onto a medium; a transport unit that transports the medium; and a control unit that forms an adjustment pattern on the medium, in which the control unit forms, as the adjustment pattern, a pattern including a first pattern that is formed in a first direction, a plurality of scales that are formed in the first direction, and a second pattern that is formed at a position corresponding to the scales in the first direction while changing the position thereof in a second direction that intersects the first direction.

In this case, the adjustment pattern (test pattern) has the first pattern (reference pattern) in the first direction, the plurality of scales that are formed in the first direction, and the second pattern (variable pattern) that are formed while the position thereof in the second direction is changed. If the plurality of respective scales are made to correspond to different correction values (phase values) and a proper correction value (adjustment value) is acquired from a scale arranged near an intersecting point between the first direction and the second direction, it is possible to acquire the proper correction value by inspecting only one scale (one inspection pattern) corresponding to the proper correction value without inspecting extra scales (extra inspection patterns) corresponding to improper correction values. That is, if the scale of the proper correction value is identified by the intersecting point between the first pattern and the second pattern, it is possible to acquire the proper correction value without inspecting extra scales corresponding to improper correction values.

Therefore, since it is only necessary to inspect the one scale arranged near the intersecting point between the first pattern and the second pattern for the adjustment pattern of the liquid ejecting apparatus according to the application example, it is possible to further simplify the inspection and to achieve higher efficiency in the inspection as compared with a case in which extra scales are also inspected.

Application Example 2

In the liquid ejecting apparatus according to Application Example 1, it is preferable that the control unit form, as the second pattern, a continuous line that intersects the first pattern.

In this case, if the scale of the proper correction value is identified by the intersecting point between the first pattern in the first direction and the continuous line (second pattern) that intersects the first pattern, it is possible to acquire the proper correction value without inspecting extra scales corresponding to the improper correction values and to achieve higher efficiency in the inspection.

Application Example 3

In the liquid ejecting apparatus according to Application Example 1, it is preferable that the control unit form, as the second pattern, a plurality of lines in the first direction while changing positions thereof in the first direction and the second direction.

In this case, if the plurality of lines formed in the first direction while the positions thereof in the first direction and the second direction are changed are regarded as the second pattern, and the scale of the proper correction value is identified by a line in the first direction arranged near the first pattern, it is possible to acquire the proper correction value without inspecting the extra scales corresponding to the improper correction values and to achieve higher efficiency in the inspection.

Application Example 4

In the liquid ejecting apparatus according to Application Example 1, it is preferable that the adjustment pattern be configured such that an adjustment value is able to be acquired from one pair of the first pattern and the second pattern.

In this case, it is possible to acquire the proper correction value by one adjustment pattern that is made of the pair of the first pattern and the second pattern and to thereby achieve higher efficiency in the inspection as compared with a case in which other adjustment patterns are also inspected.

Application Example 5

In the liquid ejecting apparatus according to Application Example 1, it is preferable that the ejecting unit be configured to eject the liquid while moving in the second direction, and that the control unit form, as the adjustment pattern, a pattern for adjusting ejection timing of the liquid by the ejecting unit.

In this case, if the adjustment pattern for adjusting the ejection timing of the liquid is used, it is possible to acquire the proper correction value by inspecting only one scale corresponding to the proper correction value and to thereby efficiently acquire the correction value (adjustment value) for adjusting the ejection timing of the liquid.

Application Example 6

In the liquid ejecting apparatus according to Application Example 1, it is preferable that the ejecting unit include at least a first head and a second head, and that the control unit form, as the adjustment pattern, a first adjustment pattern for adjusting ejection timing of the liquid from the first head and a second adjustment pattern for adjusting ejection timing of the liquid from the second head.

In this case, since the ejecting unit acquires the proper correction value (adjustment value) at each of the plurality of heads, it is possible to properly adjust the ejection timing of the liquid at the respective heads.

Application Example 7

In the liquid ejecting apparatus according to Application Example 1, it is preferable that the transport unit transport the medium in the second direction, and that the control unit form, as the adjustment pattern, a pattern for adjusting the amount of transport of the medium.

In this case, since it is possible to acquire the proper correction value by inspecting only one scale (one inspection pattern) corresponding to the proper correction value if the adjustment pattern for adjusting the amount of transport of the medium is used, it is possible to efficiently acquire the correction value (adjustment value) for adjusting the amount of transport of the medium.

Application Example 8

According to Application Example 8, there is provided a method of forming an adjustment pattern by a liquid ejecting apparatus that includes an ejecting unit that ejects liquid onto a medium and a transport unit that transports the medium, the method including: forming, as an adjustment pattern, a pattern including a first pattern that is formed in a first direction, a plurality of scales that are formed in the first direction, and a second pattern that is formed at a position corresponding to the scales in the first direction while changing the position thereof in a second direction that intersects the first direction.

In this case, the adjustment pattern that includes the first pattern in the first direction, the plurality of scales that are formed in the first direction, and the second pattern that is formed while the position thereof in the second direction is changed is formed, in the method of forming an adjustment pattern according to the application example. It is possible to acquire the proper correction value by inspecting only one scale arranged near the intersecting point between the first pattern and the second pattern in the case of the adjustment pattern, and thereby to further simplify the inspection and to achieve higher efficiency in the inspection as compared with a case in which extra scales are also inspected.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
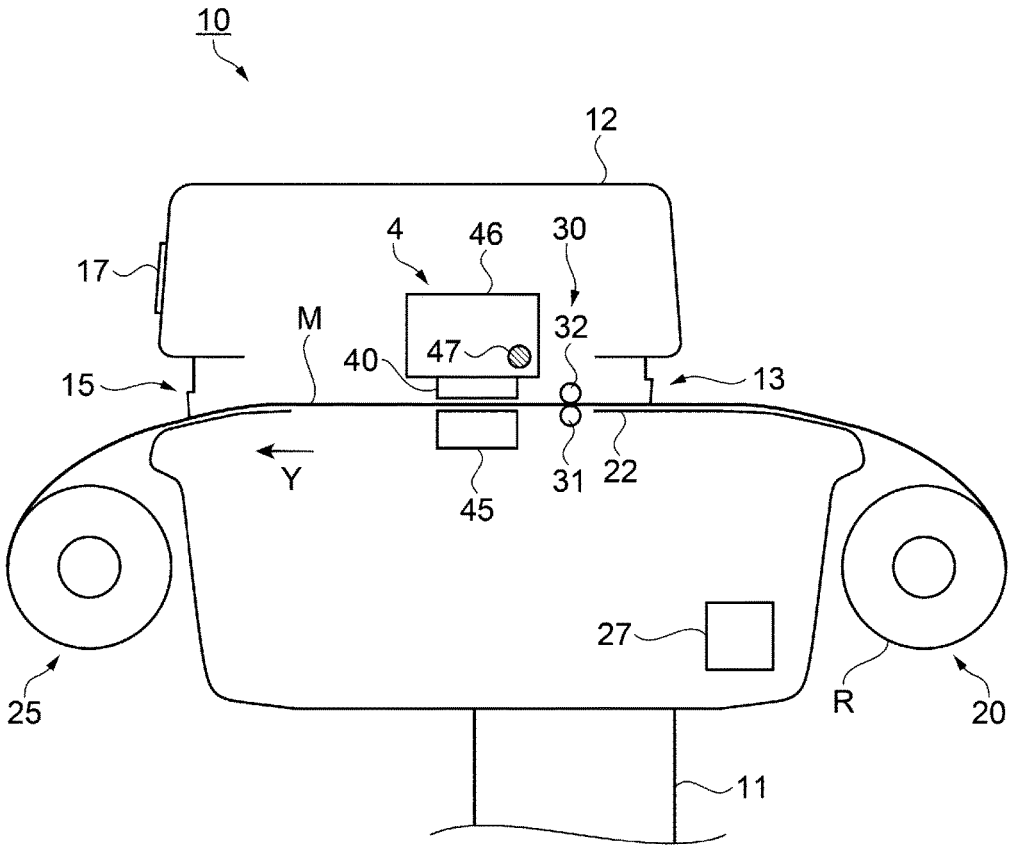
FIG. 1 is an outline sectional view showing a configuration of a printing apparatus according to Embodiment 1.

Hereinafter, embodiments of the invention will be described with reference to drawings. Such embodiments illustrate only aspects of the invention, are not intended to limit the invention, and can arbitrarily be changed within the scope of the technical concept of the invention. The respective layers and the respective parts are shown to have recognizable sizes in the drawings, and size reduction thereof does not show actual sizes in the following respective drawings.

Embodiment 1

Outline of Printing Apparatus

Figure 2:
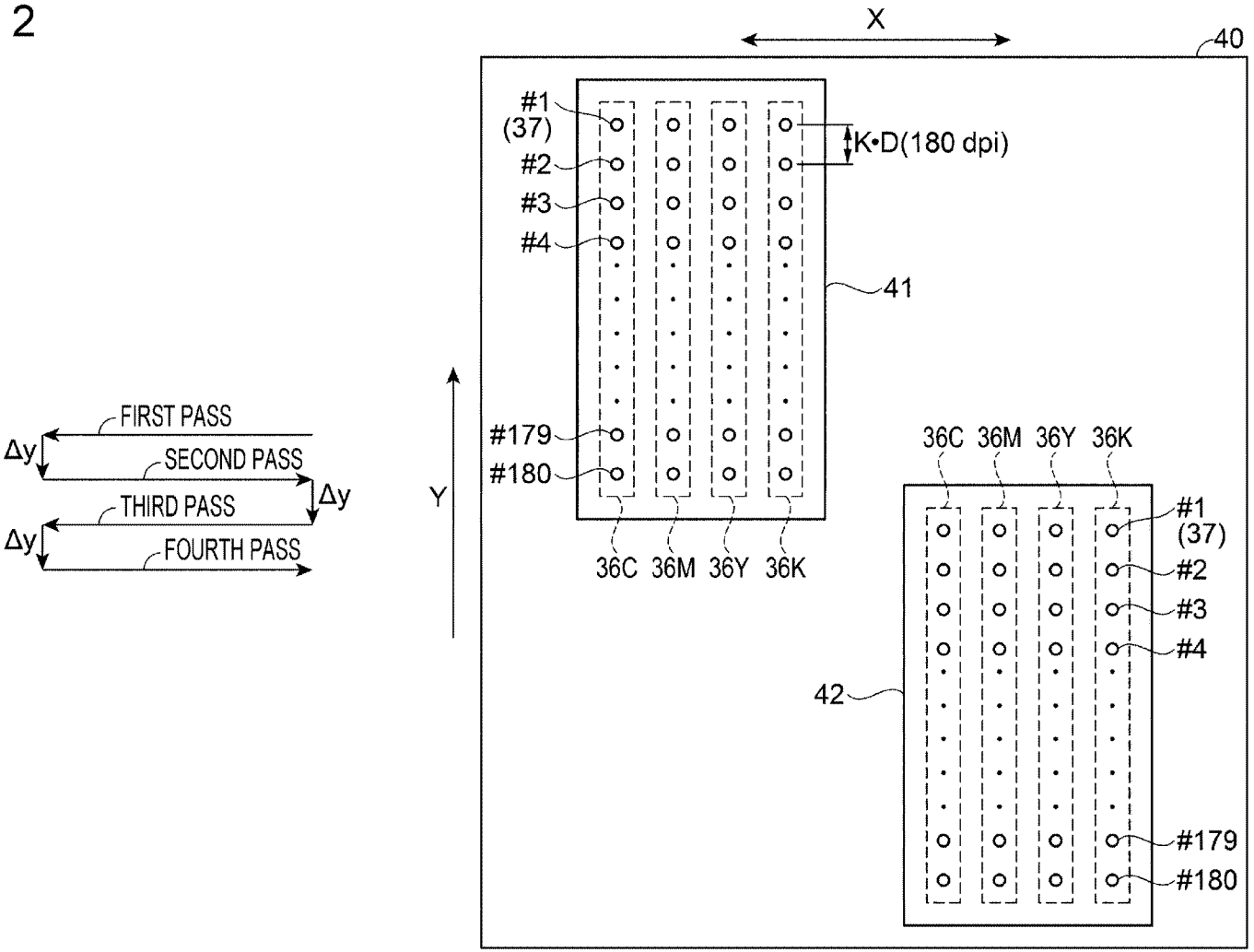
FIG. 2 is an outline planar view of a head unit.

FIG. 1 is an outline sectional view showing a configuration of a printing apparatus according to Embodiment 1. FIG. 2 is an outline planar view of a head unit. FIG. 2 shows an alignment state of nozzles 37 provided in a head unit 40.

First, an outline of a printing apparatus 10 will be described with reference to FIGS. 1 and 2.

As shown in FIG. 1, the printing apparatus 10 according to the embodiment is an example of the "liquid ejecting apparatus" and is a large format printer (LFP) that deals with a long medium M. The printing apparatus 10 includes a leg unit 11, a case body unit 12 that is supported by the leg unit 11, a set unit 20 and a winding unit 25 that are attached to both ends of the case body unit 12, and a display unit 17 that is attached to one end of the case body unit 12. As the medium M, a wood-free paper, a cast-coated paper, an art paper, a coated paper, a synthesized paper, a film made of polyethylene terephthalate (PET) or a polypropylene (PP), or the like can be used.

Inside the case body unit 12, a transport unit 30 that transports the medium M in a transport direction Y, a printing region 4, a control unit 27 that controls the respective parts of the printing apparatus 10, and a medium support unit 22 are provided.

In the following description, the direction (the width direction of the medium M) that intersects the transport direction Y will be referred to as a main-scanning direction X. Also, the transport direction Y is a sub-scanning direction that intersects the main-scanning direction X.

The medium M is unwound from a roll body R that is accommodated in the set unit 20 and is fed from a feeding port 13 to the inside of the case body unit 12. That is, the medium M fed from the set unit 20 is supported by the medium support unit 22 and is guided by the transport unit 30. The medium M that has been guided to the transport unit 30 is transported toward the printing region 4 by the transport unit 30. Then, the medium M is discharged from a discharge port 15 to the outside of the case body unit 12 after printing is performed in the printing region 4, and is then wound in a roll form by the winding unit 25.

The medium M may be a cut paper rather than the roll paper.

The transport unit 30 is arranged on the upstream side in the transport direction Y with respect to the printing region 4 and has a driving roller 31 and a driven roller 32. The driven roller 32 is in pressure contact with the driving roller 31 via the medium 31 and is rotated in a driven manner. The driving roller 31 pinches the medium M with the driven roller 32. The medium M is transported in the transport direction Y by a driving motor (not shown) driving and rotating the driving roller 31.

The display unit 17 is formed of a liquid crystal display device that has a touch panel, for example. A user can perform various kinds of setting for the printing apparatus 10 by using the touch panel of the display unit 17.

In the printing region 4, a head unit 40 as an example of the "ejecting unit", a carriage 46 that holds the head unit 40, a platen 45 that supports the medium M, and a guide shaft 47 that supports the carriage 46 are arranged.

As shown in FIG. 2, the head unit 40 has a first head 41 that is arranged on the downstream side in the transport direction Y and a second head 42 that is arranged on the upstream side in the transport direction Y.

Each of the first head 41 and the second head 42 has nozzle arrays 36C, 36M, 36Y, and 36K in which nozzles 37 for ejecting ink as an example of the "liquid" are aligned. Specifically, the nozzle array 36C for ejecting cyan (C) ink, a nozzle array 36M for ejecting magenta (M), a nozzle array 36Y for ejecting yellow (Y) ink, and a nozzle array 36K for ejecting black (K) ink are arranged in the main-scanning direction X in each of the first head 41 and the second head 42.

In each of the nozzle arrays 36C, 36M, 36Y, and 36K, 180 nozzles 37 (nozzle numbers #1 to #180) that are aligned per inch in the transport direction Y are provided at a pitch of 180 dpi. In FIG. 2, smaller nozzle numbers #n (n=1 to 180) are given to the nozzles 37 that are located closer to the downstream side in the transport direction Y.

In the following description, the nozzle 37 with the nozzle number #n will also simply be referred to as a nozzle #n in some cases.

The nozzles #1 to #180 are arranged at a constant nozzle pitch k-D in the transport direction Y. Here, D is a dot pitch in the transport direction Y. k is an integer, and a unit of k is dots. The dot pitch D in the transport direction Y is a value that depends on a printing resolution in the transport direction Y and is equal to a pitch of a luster line (an array of dots aligned in the main-scanning direction X).

In the example in FIG. 2, the nozzle pitch k·D is a value corresponding to 180 dpi. When the printing resolution (that is, the dot pitch D) in the transport direction Y is 360 dpi, the integer k is 2 dots. When the printing resolution in the transport direction Y is 720 dpi, the integer k is 4 dots.

The nozzles 37 are arranged at the constant interval (180 dpi) at each of the first head 41 and the second head 42 when viewed in the main-scanning direction X. Furthermore, the first head 41 and the second head 42 are arranged such that the interval of the nozzles 37 arranged at ends (lower ends) of the nozzle arrays in the first head 41 and the interval of the nozzles 37 arranged at ends (upper ends) of the nozzle arrays in the second head 42 are the same as the aforementioned constant interval (180 dpi) when viewed in the main-scanning direction X.

With such a configuration, the head unit 40 can be regarded as a long head in which the nozzles 37 are aligned at the constant interval (180 dpi) in the transport direction Y.

Another configuration may also be applied in which the first head 41 and the second head 42 are arranged such that the nozzles 37 arranged at the ends (lower ends) of the nozzle arrays in the first head 41 and the nozzles 37 arranged at the ends (upper ends) of the nozzles arrays in the second head 42 overlap one another when viewed in the main-scanning direction X.

The printing apparatus 10 records (prints) an image including characters, figures, and the like on the medium M by alternately repeating an operation of ejecting the ink onto the medium M while moving the head unit 40 (heads 41 and 42) in the main-scanning direction X and a linefeed operation of relatively moving the head unit 40 with respect to the medium M.

In the following description, one main-scanning operation in which the head unit 40 (heads 41 and 42) moves in the main-scanning direction X while ejecting the ink will be referred to as a "pass".

As shown on the left side in FIG. 2, the printing apparatus 10 performs printing of the first pass by performing main-scanning in which the head unit 40 is moved once to the left in the main-scanning direction X. If the printing of the first pass is completed, linefeed (sub-scanning) in which the medium M is moved by an amount of linefeed Δy in the transport direction Y and the head unit 40 is relatively moved with respect to the medium M by the amount of linefeed Δy is performed, and the head unit 40 is arranged at the next main-scanning start position (next pass start position). Subsequently, the main-scanning in which the head unit 40 is moved once from the position to the right in the main-scanning direction X is performed, and then printing of the second pass is performed. If the printing of the second pass is completed, linefeed (sub-scanning) in which the head unit 40 is relatively moved with respect to the medium M by the amount of linefeed Δy is performed, and the head unit 40 is arranged at the next main scanning start position (next pass start position). Subsequently, the main scanning in which the head unit 40 is moved once from the position to the left in the main-scanning direction X is performed, and then printing of the third pass is performed. If the printing of the third pass is completed, linefeed (sub-scanning) in which the head unit 40 is relatively moved with respect to the medium M by the amount of linefeed Δy is performed, and the head unit 40 is arranged at the next main scanning start position (next pass start position). Subsequently, the main-scanning in which the head unit 40 is moved once from the position to the right in the main-scanning direction X is performed, and then printing of the fourth pass is performed.

In the following description, the printing of the first pass and the third pass will be referred to as going path printing, and the moving path of the head unit 40 in the first pass and the third pass will be referred to as a going path. Also, the printing of the second pass and the fourth pass will be referred to as returning path printing, and the moving path of the head unit 40 in the second pass and the fourth pass will be referred to as a returning path.

As described above, the printing apparatus 10 performs printing once (one frame) by alternately repeating the going path printing, the linefeed, the returning path printing, and the linefeed and performing the main-scanning M times in accordance with a printing resolution. That is, the printing apparatus 10 performs bi-directional printing including the going path printing and the returning path printing.

In other words, the printing apparatus 10 causes the ink ejected from the head unit 40 (heads 41 and 42) onto the medium M to land at target positions (pixels) on the medium M and forms dots at the pixels on the medium M. That is, the printing apparatus 10 prints an image including characters, figures, and the like on the medium M by causing the ink ejected from the head unit 40 (heads 41 and 42) onto the medium M to land on an array of pixels (pixel array) aligned in the main-scanning direction X, forming an array of dots (luster line) aligned in the main-scanning direction X, and aligning the luster lines at the constant interval in the transport direction Y.

In the following description, the array of pixels along which the n-th luster line is formed will be referred to as a pixel array Ln in some cases.

Furthermore, the amount of linefeed Δy in the linefeed (sub-scanning) in which the head unit 40 is relatively moved in the transport direction Y with respect to the medium M is set so as not to cause banding (streak, color irregularity, and the like in the main-scanning direction X) at a joint portion (boundary) between an image formed by the going path printing and an image formed by the returning path printing. That is, the amount of linefeed Δy in the linefeed (sub-scanning) is set such that the interval of the luster lines aligned in the transport direction Y does not change at the boundary between the image formed by the going path printing and the image formed by the returning path printing.

Adjustment of Printing Apparatus

According to the printing apparatus 10, there is a case in which a moving speed of the heads 41 and 42, an ink ejection speed of the heads 41 and 42, an interval between the heads 41 and 42 and the medium M, and the like vary and an ink flying direction deviates due to a mechanical error of the carriage 46, a difference in properties of the heads 41 and 42, a difference in properties of the going path and the returning path, and the like and dots are not formed at target positions (pixels) on the medium M along the going path and the returning path. If dot formation positions (ink landing positions) along the going path and the returning path deviate, connection between the image formed by the going path and the image formed by the returning path deteriorates, and quality of the image printed on the medium M is degraded.

Thus, the printing apparatus 10 performs Bi-d (bi-direction) adjustment for adjusting ejection timing of ink from the heads 41 and 42 along the going path and the returning path. In the Bi-d adjustment, dots are formed at the target positions (pixels) on the medium M along the going path and the returning path, dot formation positions along the going path and dot formation positions along the returning path are arranged, and degradation of the quality of the image printed on the medium M is suppressed.

Furthermore, since the thickness of the medium M and a cockling state of the medium M change depending on the type of the medium M and the interval between the heads 41 and 42 and the medium M varies, the printing apparatus 10 performs the Bi-d adjustment every time the medium M is changed.

Furthermore, the amount of transport of the medium M in the transport direction Y differs in a case in which the surface of the medium M is slippery and in a case in which the surface of the medium M is not slippery even in a case in which the driving roller 31 is driven in the same manner in the printing apparatus 10. In the case in which the surface of the medium M is slippery, for example, the medium M tends not to be transported in the transport direction Y, and the transport distance of the medium M in the transport direction Y becomes shorter as compared with the case in which the surface of the medium M is not slippery.

That is, the amount of linefeed Δy in the linefeed (sub-scanning) in which the heads 41 and 42 are relatively moved in the transport direction Y with respect to the medium M differs depending on how slippery the surface of the medium M is (the type of the medium M). Therefore, the amount of linefeed Δy changes in a case in which the type of the medium M is changed, and the interval between the luster lines aligned in the transport direction Y changes at the boundary between the image formed by the going path printing and the image formed by the returning path printing. For example, black streak (dark streak) is generated in a case in which the interval of the luster lines is dense, and white streak (light streak) is generated in a case in which the interval of the luster lines is sparse at the boundary between the image formed by the going path printing and the image formed by the returning path printing.

Thus, the printing apparatus 10 performs adjustment (medium feeding adjustment) in the amount of linefeed Δy in the linefeed (sub-scanning) in which the heads 41 and 42 are relatively moved in the transport direction Y with respect to the medium M such that the amount of linefeed Δy is not changed in the case in which the type of the medium M is changed. The medium feeding adjustment is performed in the case in which the type of the medium M is changed, and a rotation angle of the driving roller 31 in the transport unit 30 is adjusted such that the amount of linefeed Δy in the linefeed (sub-scanning) is not changed.

Bi-d Adjustment

Figure 3:
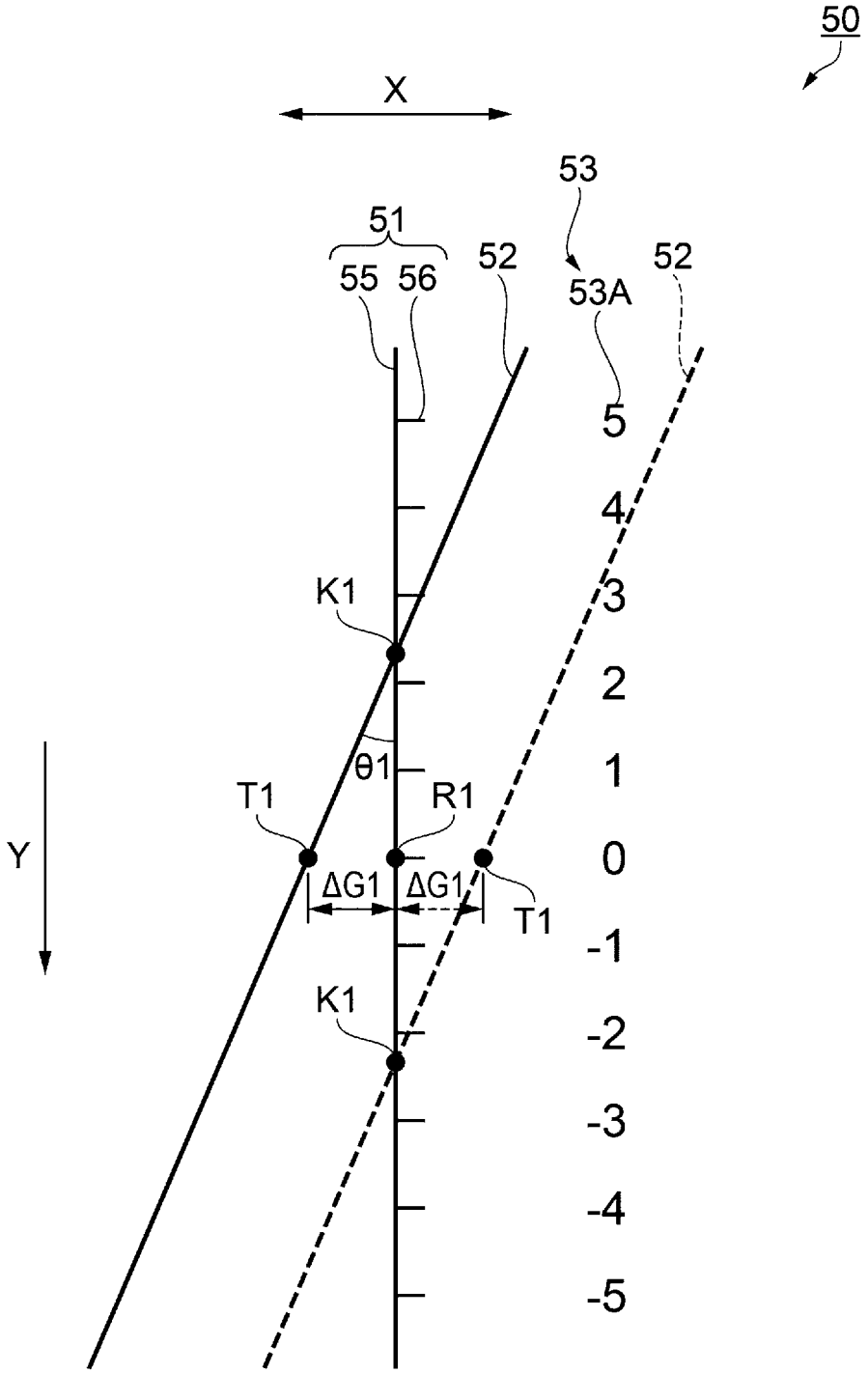
FIG. 3 is an outline diagram of an adjustment pattern for Bi-d adjustment.
Figure 4:
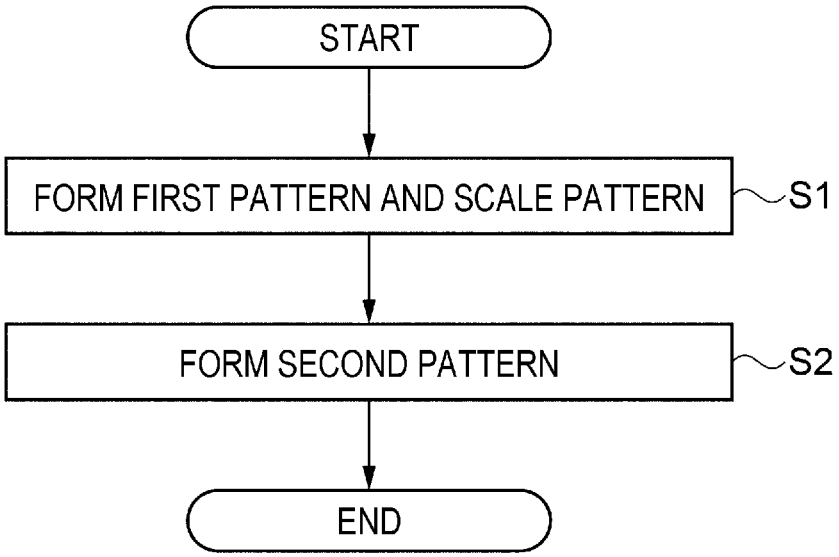
FIG. 4 is a process flow showing a method of forming the adjustment pattern for Bi-d adjustment.

FIG. 3 is an outline diagram of an adjustment pattern for the Bi-d adjustment. FIG. 4 shows a process flow showing a method of forming the adjustment pattern for the Bi-d adjustment.

Hereinafter, an outline of the Bi-d adjustment of the heads 41 and 42 will be described with reference to FIGS. 3 and 4.

Since the Bi-d adjustment is performed for each of the first head 41 and the second head 42, and the Bi-d adjustment performed on the first head 41 is the same as the Bi-d adjustment performed on the second head 42, the Bi-d adjustment of the first head 41 will be described, and description of the Bi-d adjustment of the second head 42 will be omitted in the following description.

As shown in FIG. 3, an adjustment pattern 50 for the Bi-d adjustment of the first head 41 has a first pattern 51 that is formed in the transport direction Y, a scale pattern 53 in which a plurality of scales 53A formed in the transport direction Y are aligned, and a second pattern 52 that is formed at a position corresponding to the scales 53A in the scale pattern 53 in the transport direction Y while changing the position thereof in the direction (main-scanning direction X) that intersects the transport direction Y.

As described above, the adjustment pattern 50 for the Bi-d adjustment is formed of a pair of the first pattern 51 and a second pattern 52 and a scale pattern 53.

In the adjustment pattern 50, the transport direction Y in which the first pattern 51 extends is an example of the "first direction", and the direction (main-scanning direction X) that intersects the transport direction Y is an example of the "second direction". Furthermore, the adjustment pattern 50 for the Bi-d adjustment of the first head 41 is an example of the "first adjustment pattern".

As will be described later in detail, the control unit 27 forms the adjustment pattern 50 for adjusting ejection timing of the first head 41 and an adjustment pattern (not shown) for adjusting ejection timing of the second head 42.

The adjustment pattern for the Bi-d adjustment of the second head 42 is an example of the "second adjustment pattern" and has the same configuration as that of the adjustment pattern 50 for the Bi-d adjustment of the first head 41.

The first pattern 51 has a basic line 55 in the transport direction Y and a scale line 56 that extends from the basic line 55 in the main-scanning direction X. The scale line 56 is provided so as to correspond to the scales 53A.

As will be described later in detail, the first pattern 51 is formed by the going path printing in which the first head 41 ejects the ink onto the medium M. Although the first pattern 51 is depicted as a continuous line in a macro view, the first pattern 51 is formed by a plurality of aligned dots in a micro view. At this time, the respective dots are formed by the ink ejected from the nozzles 37 and lading on the medium M. A point R1 of the first pattern 51 represents a landing position of the ink ejected from the nozzle #n of the first head 41 onto the medium M in the going path printing and represents a reference position at which the ink lands in the case in which the Bi-d adjustment of the first head 41 is performed.

In the following description, the point R1 of the first pattern 51 will be referred to as a reference point R1.

The second pattern 52 is a continuous line that intersects the first pattern 51. As will be described later in detail, the second pattern 52 is formed by the returning path printing in which the first head 41 ejects the ink onto the medium M. Although the second pattern 52 is depicted as a continuous line in a macro view, the second pattern 52 is formed by a plurality of aligned dots in a micro view. At this time, the respective dots are formed by the ink ejected from the nozzles 37 and landing on the medium M. A point T1 of the second pattern 52 is a landing position of the ink ejected from the nozzle #n of the first head 41 onto the medium M in the returning path printing.

In the following description, the point T1 of the second pattern 52 will be referred to as an adjustment point T1.

In a case in which the ink landing positions along the going path and the returning path do not deviate, the adjustment point T1 is arranged at the same position as that of the reference point R1. That is, the adjustment point T1 of the second pattern 52 that is formed by the returning path printing is arranged at the same position as that of the reference point R1 of the first pattern 51 that is formed by the going path printing.

Incidentally, in a case in which the ink landing positions in the going path and the returning path deviate due to a mechanical error of the carriage 46, a difference in properties of the heads 41 and 42, a difference in properties of the going path and the returning path, and the like, the adjustment point T1 of the second pattern 52 is not arranged at the same position as that of the reference point R1 of the first pattern 51 and is arranged so as to be deviated on the left side or the right side in the drawing with respect to the reference point R1 of the first pattern 51. In this case, the distance between the adjustment point T1 of the second pattern 52 and the reference point R1 of the first pattern 51 in the main-scanning direction X is ΔG1 which corresponds to deviation of the landing position in the returning path printing with reference to a reference value of the ink landing position (reference point R1) in the going path printing.

In the following description, the distance ΔG1 between the adjustment point T1 of the second pattern 52 and the reference point R1 of the first pattern 51 will be referred to as actual positional deviation ΔG1. The actual positional deviation ΔG1 corresponds to the length of the line (hereinafter, referred to as a line section T1R1) connecting the adjustment point T1 to the reference point R1 and is deviation of the ink landing position in the returning path printing with respect to the reference value of the ink landing position in the going path printing.

The Bi-d adjustment is adjustment for causing the reference point R1 as the ink landing position in the going path printing to coincide with the adjustment point T1 as the ink landing position in the returning path printing and eliminating the deviation of the ink landing position in the returning path printing with respect to the reference value of the ink landing position in the going path printing to zero, and is an adjustment for eliminating the actual positional deviation ΔG1 (the length of the line section T1R1) to zero.

Furthermore, the second pattern 52 passes through the adjustment point T1 and intersects the basic line 55 of the first pattern 51 at the point K1 (hereinafter, referred to as an intersecting point K1). Also, an angle (hereinafter, referred to as an intersecting angle) between the basic line 55 of the first pattern 51 and the second pattern 52 is θ1. The intersecting angle θ1 is an acute angle among the angles (the acute angle and the blunt angle) that are formed by the basic line 55 of the first pattern 51 and the second pattern 52 intersecting one another. In the embodiment, the intersecting angle θ1 is less than 45 degrees.

The scale pattern 53 is formed of the plurality of scales 53A that are formed in the transport direction Y. The scales 53A are represented by Arabic numbers. In the embodiment, the scales 53A that form the scale pattern 53 are represented by the Arabic numbers from −5 to 5. In the following description, the respective Arabic numbers from −5 to 5 of the scales 53A will be referred to as numbers −5 to 5, respectively, in some cases.

The number 0 (zero) of the scale pattern 53 is formed so as to correspond to the reference point R1. That is, the position of the reference point R1 on the basic line 55 of the first pattern 51 is recognized from the number 0 (zero) of the scale pattern 53 and the scale line 56 of the first pattern 51.

In a case in which the adjustment point T1 of the second pattern 52 is located on the left side in the drawing with respect to the reference point R1 of the first pattern 51 as represented by the solid line in the drawing, the intersecting point K1 is located on the upper side (the upstream side in the transport direction Y) in the drawing with respect to the reference point R1. Furthermore, if the actual positional deviation ΔG1 increases, the position of the intersecting point K1 moves to the upper side in the drawing.

In a case in which the adjustment point T1 of the second pattern 52 is located on the right side in the drawing with respect to the reference point R1 of the first pattern 51 as represented by the broken line in the drawing, the intersecting point K1 is located on the lower side (the downstream side in the transport direction Y) in the drawing with reference to the reference point R1. Furthermore, if the actual positional deviation ΔG1 increases, the position of the intersecting point K1 moves to the lower side in the drawing.

Therefore, it is possible to evaluate how long the actual positional deviation ΔG1 (the length of the line segment T1R1) from the position of the intersecting point K1.

In the scale pattern 53, the numbers of the scales 53A are positive on the upstream side in the transport direction Y with respect to the reference point R1 and increases as the scales 53A are further away from the reference point R1. Furthermore, the numbers of the scales 53A are negative on the downstream side in the transport direction Y with respect to the reference point R1 and decrease as the scales 53A are further away from the reference point R1.

The position of the intersecting point K1 can be evaluated based on the scale 53A of the scale pattern 53. Furthermore, it is possible to evaluate how long the actual positional deviation ΔG1 is from the intersecting point K1 and the scale 53A of the scale pattern 53. In a case in which the intersecting point K1 is located at the number 3 in the scale pattern 53, for example, the actual positional deviation ΔG1 increases as compared with a case in which the intersecting point K1 is located at the number 2 in the scale pattern 53. In a case in which the intersecting point K1 is located at the number −3 in the scale pattern 53, for example, the actual positional deviation ΔG1 increases as compared with a case in which the intersecting point K1 is located at the number −2 in the scale pattern 53.

The printing apparatus 10 registers adjustment values for eliminating the actual positional deviation ΔG1 to zero so as to correspond to the respectively scales 53A of the scale pattern 53. That is, the printing apparatus 10 registers the adjustment values for the Bi-d adjustment so as to correspond to the respective scales 53A of the scale pattern 53. Furthermore, the adjustment values for eliminating the actual positional deviation ΔG1 to zero differ depending on the type of the medium M. The "adjustment value for eliminating the actual positional deviation ΔG1" is an adjustment value for theoretically eliminating the positional deviation ΔG1 to zero. That is, the actual positional deviation ΔG1 does not necessarily become zero as a result of the adjustment using the values. However, the value can cause the actual positional deviation ΔG1 to approach zero to the maximum extent even if the actual positional deviation ΔG1 does not become zero.

The scales 53A of the scale pattern 53 are not limited to the Arabic numbers, and may be symbols such as Roman numbers or alphabets, symbols such as Greek characters, symbols with different shapes such as O and Δ, or marks with different colors such as a blue circle and a red circle, for example.

In a case in which the scales 53A of the scale pattern 53 are symbols with different shapes such as O and Δ, for example, the adjustment values for eliminating the actual positional deviation ΔG1 are registered so as to correspond to the respective symbols with different shapes such as O and Δ.

A user reads the scale 53A that is located at the closest position to the intersecting point K1 from the adjustment pattern 50 and acquires a proper adjustment value for eliminating the actual positional deviation ΔG1 to zero from the scale 53A that is located at the closest position to the intersecting point K1. In a case in which the second pattern 52 is the solid line in FIG. 3, the scale 53A that is located at the closest position to the intersecting point K1 is the number 2. Therefore, the user acquires the number 2 that is located at the closest position to the intersecting point K1 from the adjustment pattern 50 and inputs the number 2 to the printing apparatus 10 via the touch panel of the display unit 17.

Specifically, the display unit 17 includes icons corresponding to the scales 53A of the scale pattern 53, that is, icons corresponding to the numbers −5 to 5. The user touches the icon corresponding to the number 2 on the display unit 17 and inputs the number 2 to the printing apparatus 10.

Then, the printing apparatus 10 sets the proper adjustment value for eliminating the actual positional deviation ΔG1 to zero by the adjustment value registered so as to correspond to the number 2, adjusts the ejection timing of the ink by the first head 41 along the going path and the returning path, and performs the Bi-d adjustment to eliminate the actual positional deviation ΔG1 to zero.

In a case in which the scales 53A are symbols with different shapes such as O and Δ, and the scale 53A that is located at the closest position to the intersecting point K1 is the symbol Δ, the user touches the icon corresponding to the symbol Δ on the display unit 17 and inputs the symbol Δ to the printing apparatus 10.

Then, the printing apparatus 10 sets the proper adjustment value for eliminating the actual positional deviation ΔG1 to zero by the adjustment value registered for the symbol Δ, adjusts the ejection timing of the ink by the first head 41 along the going path and the returning path, and performs the Bi-d adjustment for eliminating the actual positional deviation ΔG1 to zero.

In the case in which the second pattern 52 is the solid line in FIG. 3, the scale 53A of the scale pattern 53 that is located at the closest position to the intersecting point K1 is the number 2 as described above. However, even if the user determines (reads) the scale 53A of the scale pattern 53 that is located at the closest position to the intersecting point K1 is the number 3 and inputs the number 3 to the printing apparatus 10, and the Bi-d adjustment is performed with the adjustment value registered for the number 3 in a case in which the second pattern 52 is the solid line in FIG. 3, the dot formation position in the going path printing and the dot formation position in the returning path printing are arranged in such a level that is high enough for actual use.

The scale line 56 of the first pattern 51 is provided so as to correspond to the scales 53A. The user can easily read the scale 53A that is located at the closest position to the intersecting point K1 by providing the scale line 56 in the first pattern 51.

Another configuration can also be applied in which the first pattern 51 does not include the scale line 56 and the user reads the scale 53A of the scale pattern 53 that is located at the closest position to the intersecting point K1 from the basic line 55 of the first pattern 51, the second pattern 52, and the scale pattern 53.

As shown in FIG. 4, the method of forming the adjustment pattern 50 includes a process of forming the first pattern 51 and the scale pattern 53 (Step S1) and a process of forming the second pattern 52 (Step S2).

In Step S1, the control unit 27 controls the first head 41, executes the going path printing in which the first head 41 ejects the ink onto the medium M, and forms the first pattern 51 in the transport direction Y and the scale pattern 53 including the plurality of scales 53A aligned in the transport direction Y.

In Step S2, the control unit 27 controls the first head 41, executes the returning path printing in which the first head 41 ejects the ink onto the medium M, and forms the second pattern 52 that is arranged at the position corresponding to the scales 53A in the transport direction Y while changing the position thereof in the direction (main-scanning direction X) that intersects the transport direction Y. That is, in Step S2, the control unit 27 controls the first head 41 and forms the second pattern 52 that is a continuous line that intersects the first pattern 51.

In the method of forming the adjustment pattern 50, the linefeed (sub-scanning) in which the first head 41 is relatively moved by the amount of linefeed Δy with respect to the medium M is not performed between the going path printing (Step S1) and the returning path printing (Step S2). Furthermore, the scale pattern 53 may be formed in Step S2, or the scale pattern 53 may be formed in different processes in Steps S1 and S2.

As described above, the control unit 27 forms the adjustment pattern 50 including the first pattern 51 that is formed in the transport direction Y, the plurality of scales 53A that are formed in the transport direction Y, and the second pattern 52 that is formed at the position corresponding to the scales 53A in the transport direction Y while changing the position thereof in the main-scanning direction X that intersects the transport direction Y by causing the same nozzle #n of the first head 41 to eject the ink onto the medium M in the going path printing (Step S1) and the returning path printing (Step S2).

In other words, the head unit 40 (heads 41 and 42) are configured to eject the ink while moving in the main-scanning direction X, and the control unit 27 forms, as the adjustment pattern 50, the pattern for adjusting the ejection timing of the ink by the head unit 40 (heads 41 and 42).

Next, effects of the adjustment pattern 50 for the Bi-d adjustment will be described.

Figure 5:
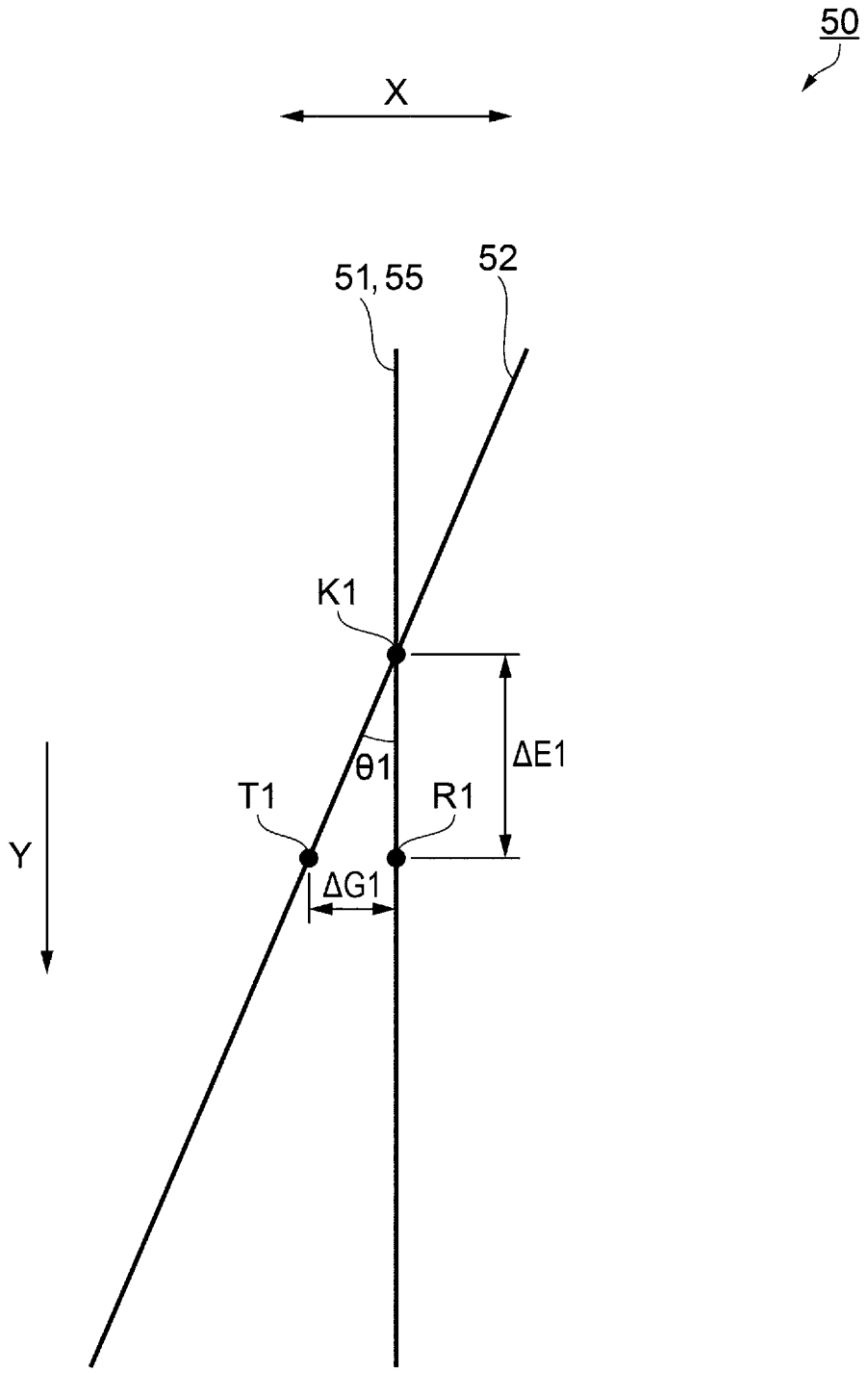
FIG. 5 is an outline diagram illustrating one of effects of the adjustment pattern for Bi-d adjustment.

FIG. 5 is a diagram corresponding to the solid line in FIG. 3 and is an outline diagram illustrating one of the effects of the adjustment pattern for the Bi-d adjustment. In FIG. 5, the scale pattern 53 and the scale line 56 are omitted.

As shown in FIG. 5, the intersecting angle θ1 is an angle between a line (hereinafter, referred to as a line segment K1R1) that connects the intersecting point K1 and the reference point R1 and a line (line segment T1R1) that connects the adjustment point T1 and the reference point R1. If the length of the line segment K1R1 is assumed to be ΔE1, a relationship of tan θ1=(the actual positional deviation ΔG1)/(the length ΔE1 of the line segment K1R1) is satisfied. Therefore, a relationship of (the length ΔE1 of the line segment K1R1)=(the actual positional deviation ΔG1)/tan θ1 is satisfied.

As described above, the length ΔE1 of the line segment K1R1 and the actual positional deviation ΔG1 (the length of the line segment T1R1) are in a proportional relationship, and the length ΔE1 of the line segment K1R1 can be obtained by dividing the actual positional deviation ΔG1 (the length of the line segment T1R1) by tan θ1.

In a case in which the intersecting angle θ1 is less than 45 degrees, the tan θ1 is less than 1. Therefore, the length ΔE1 of the line segment K1R1 is longer than the actual positional deviation ΔG1. That is, in a case in which the intersecting angle θ1 is less than 45 degrees, the actual positional deviation ΔG1 (the length of the line segment T1R1) is converted into the length ΔE1 of the line segment K1R1 that is longer than the actual positional deviation ΔG1.

In a case in which the intersecting angle θ1 is greater than 45 degrees, tan θ1 is greater than 1. Therefore, the length ΔE1 of the line segment K1R1 is shorter than the actual positional deviation ΔG1. That is, in the case in which the intersecting angle θ1 is greater than 45 degrees, the actual positional deviation ΔG1 (the length of the line segment T1R1) is converted into the length ΔE1 of the line segment K1R1 that is obtained by reducing the actual positional deviation ΔG1.

Therefore, if the second pattern 52 that intersects the first pattern 51 is provided, and the intersecting angle θ1 is less than 45 degrees, it is possible to enlarge the actual positional deviation ΔG1 (the length of the line segment T1R1) to the length ΔE1 of the line segment K1R1 that is longer than the actual positional deviation ΔG1. Also, the angle θ1 (intersecting angle θ1) between the line segment K1R1 and the line segment T1R1 is preferably less than 45 degrees in order to enlarge the actual positional deviation ΔG1 (the length of the line segment T1R1) to the length ΔE1 of the line segment K1R1 that is longer than the actual positional deviation ΔG1 in the adjustment pattern 50.

In a case in which the positions of the reference point R1 as a reference value of the ink landing position in the going path printing and the adjustment point T1 as the ink landing position in the returning path printing is slightly different, it is difficult for an operator to visually evaluate the difference between the positions from the actual positional deviation ΔG1 (that is, the position of the adjustment point T1).

Since the intersecting angle θ1 is less than 45 degrees, the actual positional deviation ΔG1 is enlarged to the length ΔE1 of the line segment K1R1 that is longer than the actual positional deviation ΔG1 in the embodiment. Therefore, even in the case in which the positions of the reference point R1 as the ink landing position in the going path printing and the adjustment point T1 as the ink landing position in the returning path printing is slightly different, the operator can easily visually evaluate the different between the positions and easily acquire the proper adjustment value for the Bi-d adjustment by observing the length ΔE1 of the line segment K1R1 (that is, the position of the intersecting point K1).

Therefore, if the proper adjustment value for the Bi-d adjustment is acquired by the length ΔE1 of the line segment K1R1, it is possible to easily acquire the proper adjustment value as compared with a case in which the proper adjustment value for the Bi-d adjustment is acquired from the actual positional deviation ΔG1 and to thereby perform the proper Bi-d adjustment.

The adjustment pattern 50 according to the embodiment is formed of the one pair of the first pattern 51 and the second pattern 52 and the plurality of scales 53A, and the printing apparatus 10 registers different adjustment values (adjustment values for the Bi-d adjustment) so as to correspond to the plurality of respective scales 53A. That is, the adjustment pattern 50 is configured to be able to acquire the adjustment value (the proper adjustment value for the Bi-d adjustment) from the one pair of the first pattern 51 and the second pattern 52. Then, the proper adjustment value for the Bi-d adjustment is acquired from the scale 53A that is located near the intersecting point K1 between the first pattern 51 and the second pattern 52.

Therefore, it is only necessary to inspect the scale 53A that is located near the intersecting point K1 between the first pattern 51 and the second pattern 52, and there is no need to inspect other extra scales 53A that are not located near the intersecting point K1 between the first pattern 51 and the second pattern 52. Therefore, it is possible to acquire the proper adjustment value in short time and to achieve higher efficiency in the operations as compared with the case in which other extra scales 53A are also inspected.

Furthermore, since it is possible to acquire the proper adjustment value for the Bi-d adjustment with only the one adjustment pattern 50 in the embodiment, it is possible to reduce the number of the adjustment patterns formed on the medium M and to save the space of the adjustment patterns formed on the medium M as compared with the case in which the plurality of adjustment patterns are used for the inspection, for example. In addition, it is possible to reduce the amount of consumable supplies (for example, the ink, the medium M, and the like) used to form the adjustment pattern and to reduce the cost of the adjustment pattern.

The effects such as the efficiency of the operations, the saving of the space for the adjustment pattern, the reduction in the cost of the adjustment pattern are exhibited more significantly in a case in which the head unit 40 has a lot of heads, a case in which the plurality of head units 40 are provided, and the like.

Medium Feeding Adjustment

Figure 6:
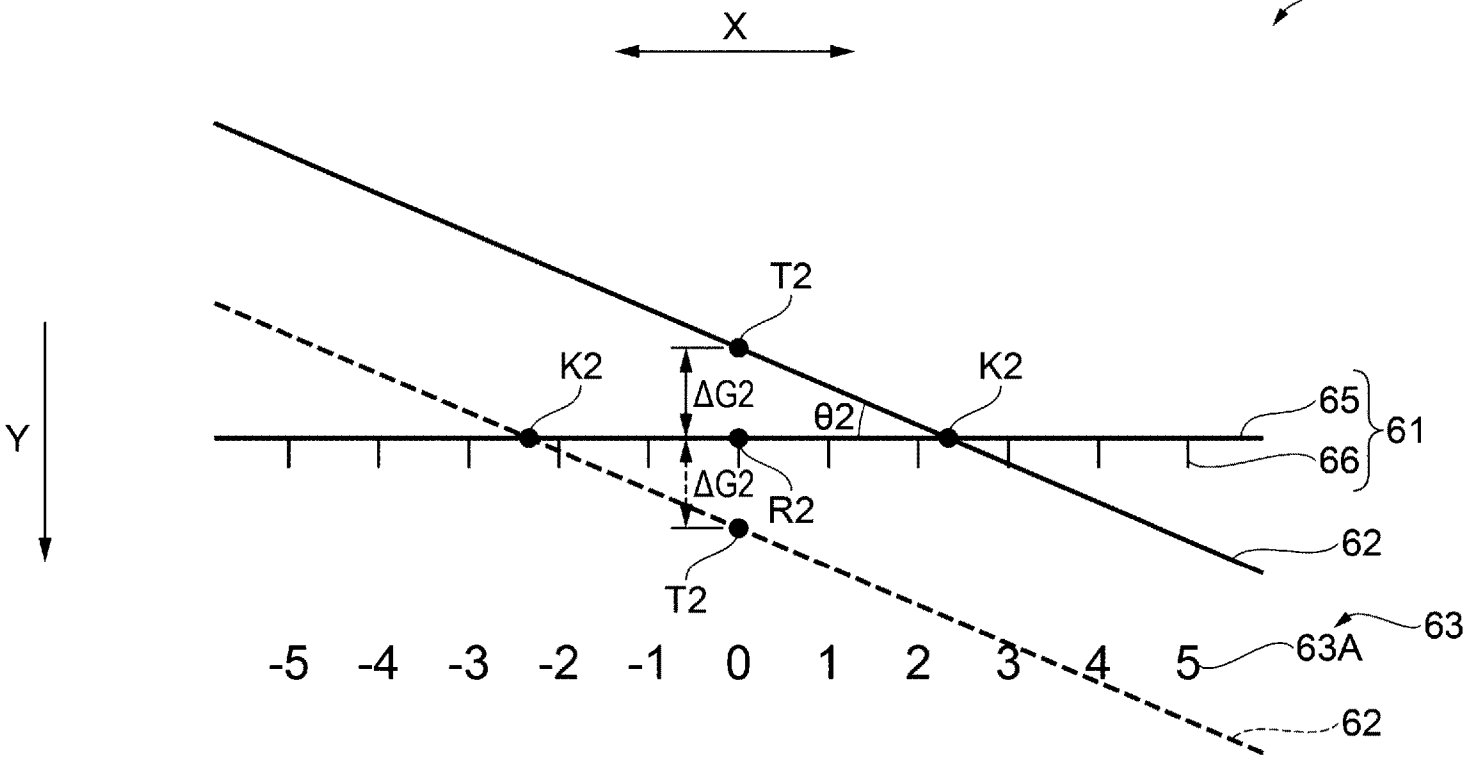
FIG. 6 is an outline diagram of an adjustment pattern for medium feeding adjustment.
Figure 7:
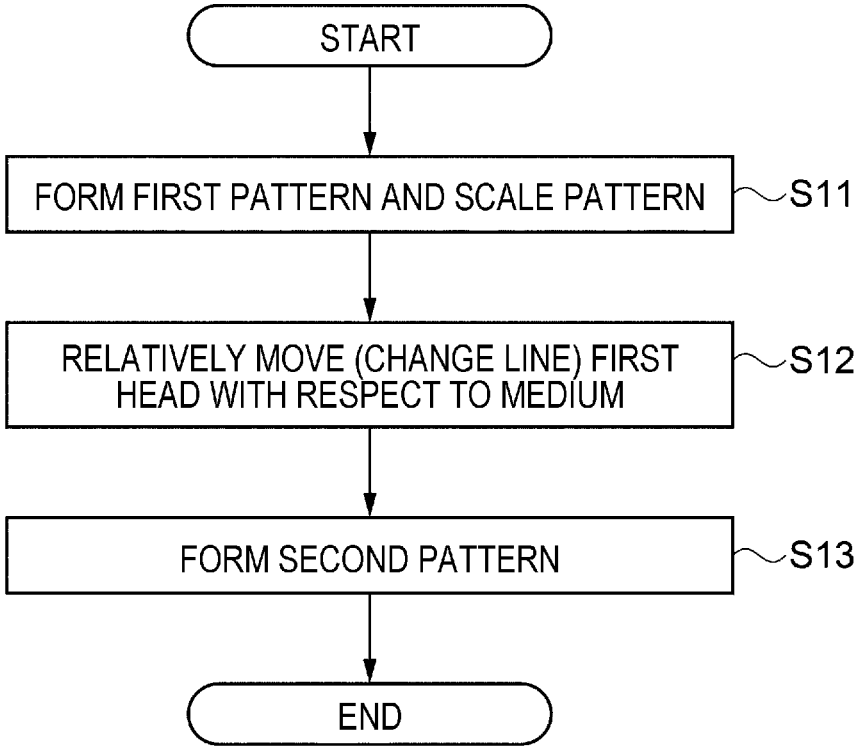
FIG. 7 is a process flow showing a method of forming the adjustment pattern for the medium feeding adjustment.
Figure 8:
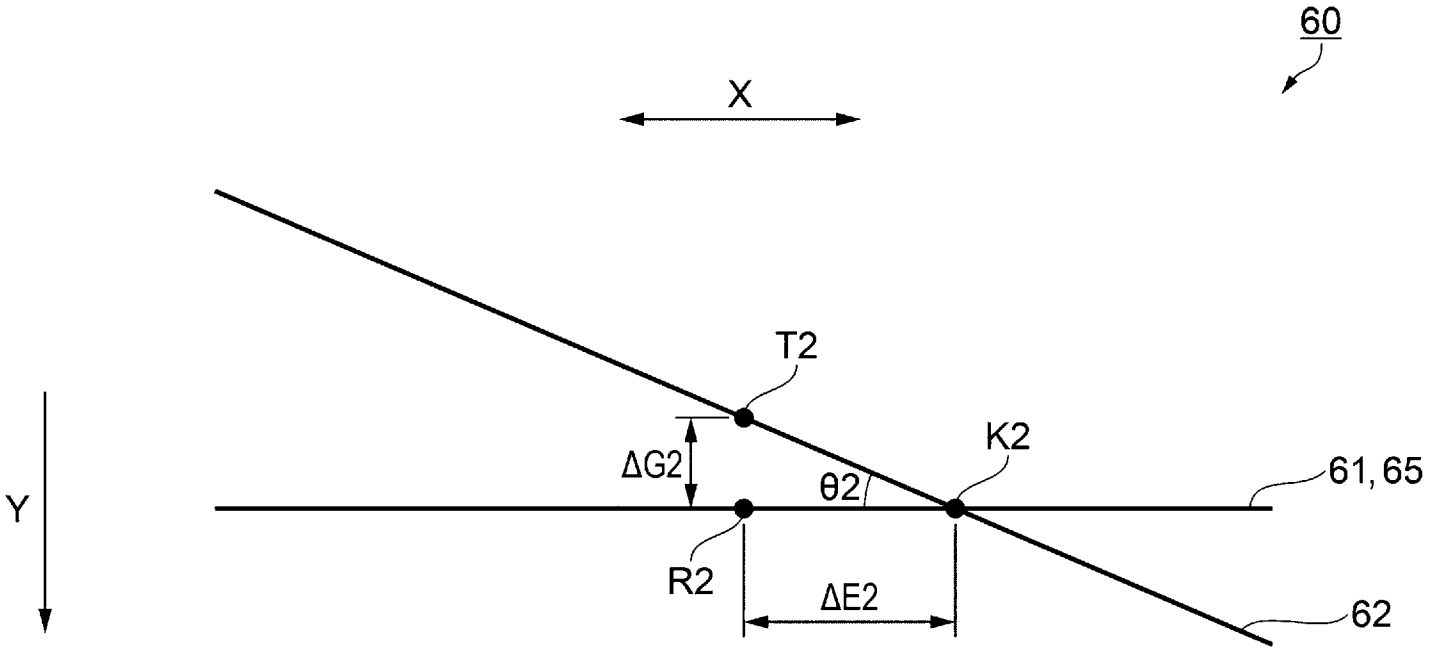
FIG. 8 is an outline diagram illustrating one of effects of the adjustment pattern for the medium feeding adjustment.

FIG. 6 is an outline diagram of an adjustment pattern for medium feeding adjustment. FIG. 7 shows a process flow showing a method of forming the adjustment pattern for the medium feeding adjustment. FIG. 8 is a diagram corresponding to the solid line in FIG. 6 and is an outline diagram illustrating one of effects of the adjustment pattern for the medium feeding adjustment.

An adjustment pattern 60 for medium feeding adjustment shown in FIG. 6 has the same configuration as that of the adjustment pattern 50 (see FIG. 3) for the Bi-d adjustment.

That is, a first pattern 61 of the adjustment pattern 60 corresponds to the first pattern 51 of the adjustment pattern 50. A second pattern 62 of the adjustment pattern 60 corresponds to the second pattern 52 of the adjustment pattern 50. A scale pattern 63 of the adjustment pattern 60 corresponds to the scale pattern 53 of the adjustment pattern 50. A reference point R2 of the adjustment pattern 60 corresponds to the reference point R1 of the adjustment pattern 50. An adjustment point T2 of the adjustment pattern 60 corresponds to the adjustment point T1 of the adjustment pattern 50. An intersecting point K2 of the adjustment pattern 60 corresponds to the intersecting point K1 of the adjustment pattern 50. An intersecting angle θ2 of the adjustment pattern 60 corresponds to the intersecting angle θ1 of the adjustment pattern 50. Actual positional deviation ΔG2 of the adjustment pattern 60 corresponds to the actual positional deviation ΔG1 of the adjustment pattern 50. A length ΔE2 of a line segment K2R2 of the adjustment pattern 60 corresponds to the length ΔE1 of the line segment K1R1 of the adjustment pattern 50.

In contrast, the direction in which the components (the first pattern 61 and the second pattern 62) of the adjustment pattern 60 for the medium feeding adjustment extend is different from the direction in which the components (the first pattern 51 and the second pattern 52) of the adjustment pattern 50 for the Bi-d adjustment extend. This is a difference between the adjustment pattern 60 for the medium feeding adjustment and the adjustment pattern 50 for the Bi-d adjustment.

Next, an outline of the medium feeding adjustment of the head unit 40 (head units 41 and 42), mainly differences from the Bi-d adjustment of the heads 41 and 42 will be described with reference to FIGS. 6 to 8. Description of overlapping content will be omitted.

The medium feeding adjustment of the head unit 40 is performed by using the adjustment pattern 60 that is formed by the ink ejected from the first head 41 or the second head 42. In the following description, the adjustment pattern 60 for the medium feeding adjustment of the head unit 40 is assumed to be formed by the ink ejected from the first head 41.

As shown in FIG. 6, the first pattern 61 and scales 63A of the scale pattern 63 of the adjustment pattern 60 for the medium feeding adjustment are formed in the main-scanning direction X. The second pattern 62 is formed at a position corresponding to the scales 63A of the scale pattern 63 in the direction that intersects the main-scanning direction X while changing the position thereof in the direction (transport direction Y) that intersects the main-scanning direction X.

The main-scanning direction X in which the first pattern 61 extends is an example of the "first direction", and the direction (transport direction Y) that intersects the main-scanning direction X is an example of the "second direction" in the adjustment pattern 60.

In a case in which the amount of linefeed Δy in the linefeed is not changed, the position of the reference point R2 of the first pattern 61 coincides with the position of the adjustment point T2 of the second pattern 62. In a case in which the amount of linefeed Δy in the linefeed is changed, the position of the reference point R2 of the first pattern 61 does not coincide with the position of the adjustment point T2 of the second pattern 62.

Therefore, it is possible to recognize how the amount of linefeed Δy in the linefeed has changed depending on how long the actual positional deviation ΔG2 is.

In a case in which the surface of the medium M is slippery, for example, the medium M tends not to be transported in the transport direction Y, and the transport distance of the medium M in the transport direction Y becomes shorter as compared with a case in which the surface of the medium M is not slippery. In such a case, the adjustment point T2 is located on the downstream side in the transport direction Y with respect to the reference point R2 as shown by the broken line in FIG. 6. In a case in which the adjustment point T2 is located on the downstream side in the transport direction Y with respect to the reference point R2, the intersecting point K2 is located on the left side in the drawing with reference to the reference point R2. Furthermore, in a case in which the actual positional deviation ΔG2 increases, the position of the intersecting point K2 moves to the left side in the drawing.

In the case in which the surface of the medium M is not slippery, for example, the medium M tends to be transported in the transport direction Y, and the transport distance of the medium M in the transport direction Y becomes longer as compared with the case in which the surface of the medium M is slippery. In this case, the adjustment point T2 is located on the upstream side in the transport direction Y with respect to the reference point R2 as shown by the solid line in FIG. 6. In the case in which the adjustment point T2 is located on the upstream side in the transport direction Y with respect to the reference point R2, the intersecting point K2 is located on the right side in the drawing with respect to the reference point R2. Furthermore, in the case in which the actual positional deviation ΔG2 increases, the position of the intersecting point K2 moves to the right side in the drawing.

It is possible to evaluate how long the actual positional deviation ΔG2 is depending on the position of the intersecting point K2.

It is possible to evaluate the position of the intersecting point K2 depending on the scales 63A of the scale pattern 63. Furthermore, it is possible to evaluate how long the actual positional deviation ΔG2 is depending on the intersecting point K2 and the scales 63A of the scale pattern 63. In a case in which the intersecting point K2 is located at the number 3 in the scale pattern 63, for example, it is possible to determine that the actual positional deviation ΔG2 is longer as compared with a case in which the intersecting point K2 is located at the number 2 in the scale pattern 63. In a case in which the intersecting point K2 is located at the number −3 in the scale pattern 63, for example, it is possible to determine that the actual positional deviation ΔG2 is longer as compared with a case in which the intersecting point K2 is located at the number −2 in the scale pattern 63.

Adjustment values for eliminating the actual positional deviation ΔG2 to zero are registered in the printing apparatus 10 so as to correspond to the respective scales 63A of the scale pattern 63. That is, the adjustment values for the medium feeding adjustment are registered in the printing apparatus 10 so as to correspond to the respective scales 63A of the scale pattern 63. The adjustment values for eliminating the actual positional deviation ΔG2 to zero differ depending on the type of the medium M.

The user reads the scale 63A of the scale pattern 63 that is located at the closest position to the intersecting point K2 from the adjustment pattern 60. In a case in which the second pattern 62 is the solid line in FIG. 6, the scale 63A of the scale pattern 63 that is located at the closest position to the intersecting point K2 is the number 2. Therefore, the user acquires the number 2 that is located at the closest position to the intersecting point K2 from the adjustment pattern 60. Then, if the user inputs the number 2 to the printing apparatus 10, the medium feeding adjustment for adjusting the rotation angle of the driving roller 31 in the transport unit 30 and eliminating the actual positional deviation ΔG2 to zero is performed with the adjustment value registered for the number 2.

However, it is possible to suppress the banding at the boundary between the image formed in the going path printing and the image formed in the returning path printing to such a level that is high enough for practical use even in a case in which the user determines (reads) that the number in the scale pattern 63 that is located at the closest position to the intersecting point K2 is 3 and inputs the number 3 to the printing apparatus 10, and the medium feeding adjustment is performed with the adjustment value registered for the number 3 in a case in which the second pattern 62 is the solid line in FIG. 6.

As shown in FIG. 7, the method of forming the adjustment pattern 60 includes a process of forming the first pattern 61 and the scale pattern 63 (Step S11), a process of relatively moving the first head 41 with respect to the medium M (Step S12), and a process of forming the second pattern 62 (Step S13).

In Step S11, the control unit 27 controls the first head 41 such that the ink ejected from the nozzle #n of the first head 41 lands on a reference pixel (a pixel that forms the reference point R2) on the pixel array Ln, executes the going path printing in which the first head 41 ejects the ink onto the medium M, and forms the first pattern 61 in the main-scanning direction X and the scale pattern 63 including the plurality of scales 63A that are aligned in the main-scanning direction X.

In Step S12, the control unit 27 controls the first head 41, performs linefeed (sub-scanning) in which the first head 41 is relatively moved by the amount of linefeed Δy with respect to the medium M, and arranges the first head 41 at the next main scanning start position (the start position of the returning path printing).

Specifically, the control unit 27 linefeeds the first head 41 such that the ink ejected from a nozzle #m of the first head 41 lands on a reference pixel (a pixel that forms the reference point R2) on the pixel array Ln. That is, the control unit 27 relatively moves the first head 41 by the amount of linefeed Δy with respect to the medium M such that the ink ejected in the returning path printing (Step S13), which will be described later, lands on the same pixel array Ln as that on which the ink lands in the aforementioned path printing (Step S11). Specifically, the relative movement between the first head 41 and the medium M is performed by transporting the medium M in the transport direction Y. The nozzle #m is a nozzle that is located on the downstream side beyond the nozzle #n in the transport direction Y by the amount of linefeed Δy.

In Step S13, the control unit 27 controls the first head 41 such that the ink ejected from the nozzle #m of the first head 41 lands on the reference pixel (the pixel that forms the reference point R2) on the pixel array Ln. Specifically, the control unit 27 controls the first head 41, executes the returning path printing in which the first head 41 ejects the ink onto the medium M, and forms the second pattern 62 at a position corresponding to the scales 63A of the scale pattern 63 in the main-scanning direction X while positioning the positions in the direction (transport direction Y) that intersects the main-scanning direction X.

As described above, the control unit 27 causes the ink ejected from the first head 41 to land on the same pixel array Ln in each of the going path printing (Step S11) and the returning path printing (Step S13) by the going path printing (Step S11), the linefeed (Step S12), and the returning path printing (Step S13) to form the adjustment pattern 60 including the first pattern 61 that is formed in the main-scanning direction X, the plurality of scales 63A that are formed in the main-scanning direction X, and the second pattern 62 that is formed at the position corresponding to the scales 63A in the main-scanning direction X while changing the position thereof in the transport direction Y that intersects the main-scanning direction X.

In other words, the transport unit 30 transports the medium M in the transport direction Y, and the control unit 27 forms, as the adjustment pattern 60, the pattern for adjusting the amount of transport of the medium M.

Next, effects of the adjustment pattern 60 for the medium feeding adjustment will be described.

As shown in FIG. 8, if the length of the line segment K2R2 is assumed to be ΔE2, a relationship of tan θ2=(the actual positional deviation ΔG2)/(the length ΔE2 of the line segment K2R2) is satisfied. Therefore, a relationship of (the length ΔE2 of the line segment K2R2)=(the actual positional deviation ΔG2)×tan θ2 is satisfied.

In a case in which the intersecting angle θ2 is less than 45 degrees, tan θ2 is less than 1. Therefore, the length ΔE2 of the line segment K2R2 is longer than the actual positional deviation ΔG2. That is, in the case in which the intersecting angle θ2 is less than 45 degrees, the actual positional deviation ΔG2 (the length of the line segment T2R2) is converted into the length ΔE2 of the line segment K2R2 that is longer than the actual positional deviation ΔG2.

Therefore, if the second pattern 62 that intersects the first pattern 61 is provided, and the intersecting angle θ2 is set to be less than 45 degrees, the actual positional deviation ΔG2 (the length of the line segment T2R2) is converted into the length ΔE2 of the line segment K2R2 that is longer than the actual positional deviation ΔG2.

Since the intersecting angle θ2 is less than 45 degrees, the actual positional deviation ΔG2 is enlarged to the length ΔE2 of the line segment K2R2 that is longer than the actual positional deviation ΔG2 in the embodiment. Therefore, even in a case in which the positions of the reference point R2 as the ink landing position in the going path printing before the linefeed and the adjustment point T2 as the ink landing position in the returning path printing after the linefeed are slightly different, the operator can easily visually evaluate the difference between the positions thereof and easily acquire the proper adjustment value for the medium feeding adjustment by observing the length ΔE2 of the line segment K2R2 (that is, the position of the intersecting position K2).

Therefore, it is possible to more easily acquire the proper adjustment value if the adjustment value for the medium feeding adjustment is acquired from the length ΔE2 of the line segment K2R2 as compared with a case in which the adjustment value for the medium feeding adjustment is acquired from the actual positional deviation ΔG2, and to thereby properly perform the medium feeding adjustment.

The adjustment pattern 60 according to the embodiment is formed of a pair of the first pattern 61 and the second pattern 62 and the plurality of scales 63A, and the printing apparatus 10 registers different adjustment values (adjustment values for the medium feeding adjustment) so as to correspond to the plurality of respective scales 63A. That is, the adjustment pattern 60 is configured so as to be able to acquire an adjustment value (a proper adjustment value for the medium feeding adjustment) from the pair of the first pattern 61 and the second pattern 62. In addition, the proper adjustment value for the medium feeding adjustment is acquired from a scale 63A that is located near the intersecting point K2 between the first pattern 61 and the second pattern 62.

Therefore, it is only necessary to inspect the scale 63A that is located near the intersecting point K2 between the first pattern 61 and the second pattern 62, and it is not necessary to inspect other extra scales 63A that are not located near the intersecting point K2 between the first pattern 61 and the second pattern 62. Therefore, it is possible to acquire the proper adjustment value in shorter time and to achieve higher efficiency in the operation as compared with a case in which the other extra scales 63A are also inspected.

Furthermore, it is possible to acquire the proper adjustment value for the medium feeding adjustment merely from the one adjustment pattern 60, and thereby to reduce the number of the adjustment patterns formed on the medium M and to save the spaces for the adjustment patterns formed on the medium M as compared with the case in which a plurality of adjustment patterns are used for inspection, for example, in the embodiment. In addition, it is possible to reduce the amount of consumable supplies (for example, the ink, the medium M, and the like) used to form the adjustment pattern and to reduce the cost of the adjustment pattern.

The effects such as the efficiency of the operations, the saving of the space for the adjustment pattern, the reduction in the cost of the adjustment pattern are exhibited more significantly in a case in which the head unit 40 has a lot of heads, a case in which the plurality of head units 40 are provided, and the like.

Embodiment 2

Figure 9:
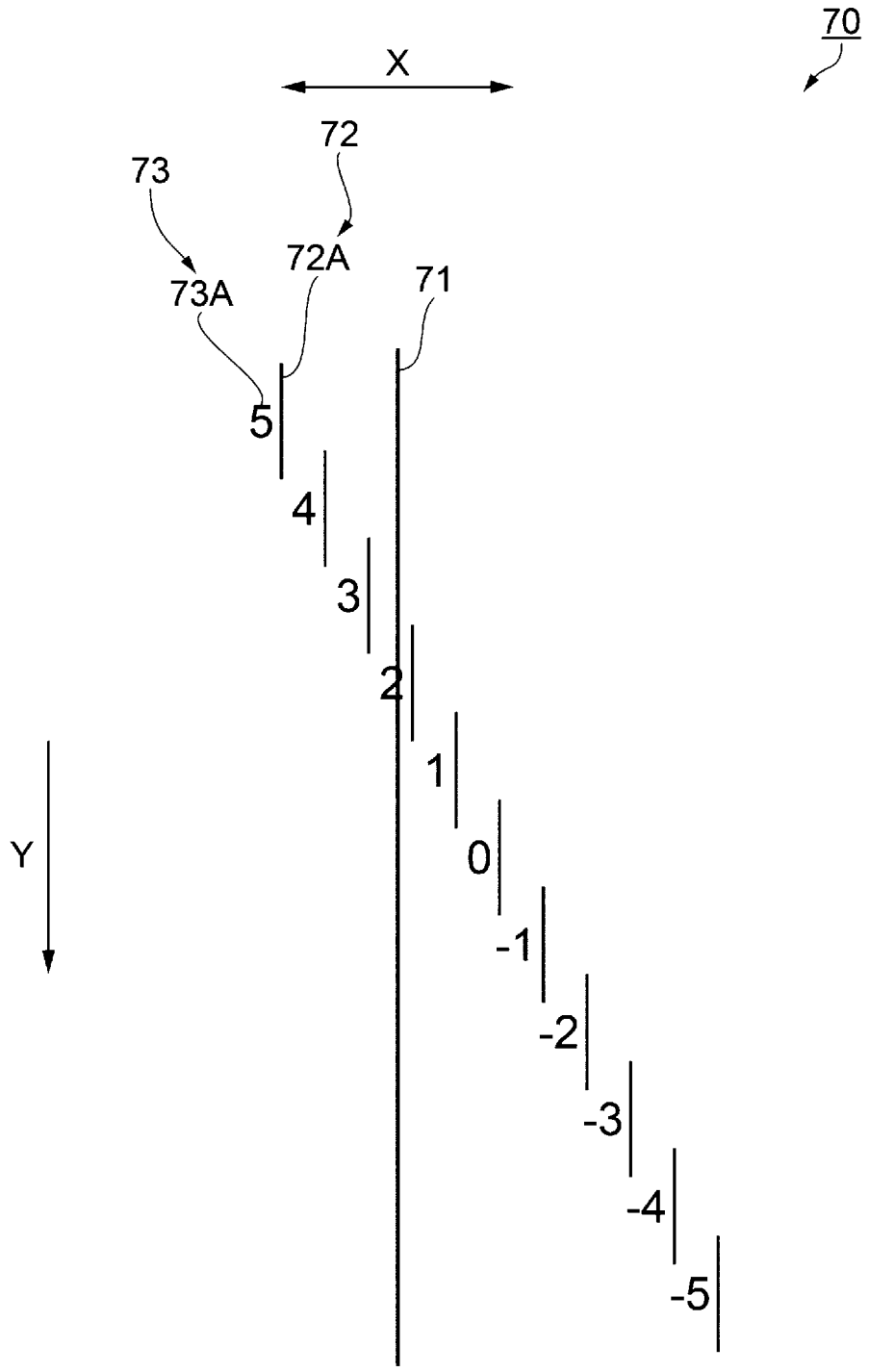
FIG. 9 is an outline diagram of an adjustment pattern for Bi-d adjustment according to Embodiment 2.
Figure 10:
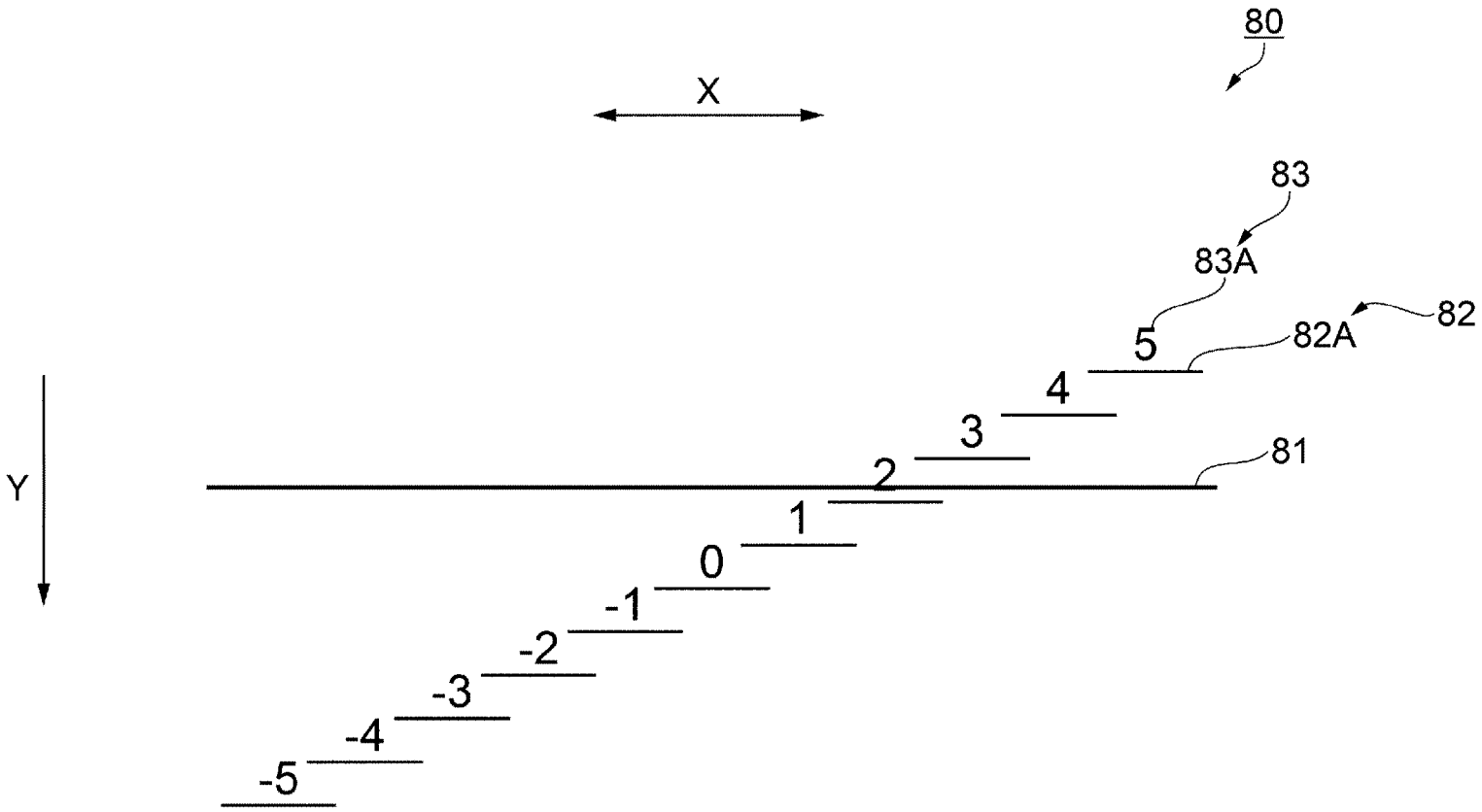
FIG. 10 is an outline diagram of an adjustment pattern for medium feeding adjustment according to Embodiment 2.

FIG. 9 is an outline diagram of an adjustment pattern for Bi-d adjustment according to Embodiment 2. FIG. 10 is an outline diagram of an adjustment pattern for medium feeding adjustment according to the embodiment.

A printing apparatus 210 according to the embodiment has the same configuration as that of the printing apparatus 10 according to Embodiment 1 and performs the same adjustment (the Bi-d adjustment and the medium feeding adjustment) as that in Embodiment 1. Furthermore, the adjustment (the Bi-d adjustment and the medium feeding adjustment) of the printing apparatus 210 according to the embodiment is performed by using adjustment patterns 70 and 80 (see FIGS. 9 and 10). The embodiment is different from Embodiment 1 in that the adjustment patterns 70 and 80 according to the embodiment are different from the adjustment patterns 50 and 60.

Hereinafter, an outline of the embodiment, mainly differences from Embodiment 1 will be described with reference to FIGS. 9 and 10. The same reference numerals will be given to the same components as those in Embodiment 1, and the description thereof will not be repeated. Bi-d adjustment As shown in FIG. 9, the adjustment pattern 70 for Bi-d adjustment of a first head 41 has a first pattern 71 that is formed in a transport direction Y, a scale pattern 73 in which a plurality of scales 73A formed in the transport direction Y are aligned, and a second pattern 72 that is formed at a position corresponding to the scales 73A in the transport direction Y while changing the position in a direction (main-scanning direction X) that intersects the transport direction Y.

In the adjustment pattern 70, the transport direction Y in which the first pattern 71 extends is an example of the "first direction", and the direction (main-scanning direction X) that intersects the transport direction Y is an example of the "second direction".

The first pattern 71 is a continuous line in the transport direction Y.

The control unit 27 controls the first head 41, executes going path printing in which the first head 41 ejects ink onto a medium M, and forms the first pattern 71.

The second pattern 72 includes a plurality of lines 72A formed in the transport direction Y while changing the positions thereof in the transport direction Y and the main-scanning direction X. That is, the second pattern 72 includes a plurality of lines 72A aligned in a direction (oblique direction) that intersects the transport direction Y and the main-scanning direction X. Also, the lines 72A of the second pattern 72 are formed at positions corresponding to the scales 73A.

The control unit 27 forms the second pattern 72 by controlling the first head 41, executing returning path printing in which the first head 41 ejects the ink onto the medium M, and forming the plurality of lines 72A in the transport direction Y while changing the positions in the transport direction Y and the main-scanning direction X.

As described above, the control unit 27 causes the first head 41 to eject the ink onto the medium M in the going path printing and the returning path printing and forms the adjustment pattern 70 including the first pattern 71 that is formed in the transport direction Y, the plurality of scales 73A that are formed in the transport direction Y, and the second pattern 72 that is formed at the position corresponding to the scales 73A in the transport direction Y while changing the position in the main-scanning direction X that intersects the transport direction Y.

In other words, the head unit 40 (heads 41 and 42) is configured to eject the ink whole moving in the main-scanning direction X, and the control unit 27 forms, as the adjustment pattern 70, the pattern for adjusting ejection timing of the ink by the head unit 40 (heads 41 and 42).

The scales 73A are formed so as to correspond to the respective lines 72A that form the second pattern 72. In the embodiment, the scales 73A are arranged on the left side with respect to the lines 72A that form the second pattern 72. That is, the scales 73A that are arranged on the left side with respect to the lines 72A that form the second pattern 72 in FIG. 9 are the scales 73A that correspond to the lines 72A. Also, the lines 72A that are arranged on the right side with respect to the scales 73A in FIG. 9 are the lines 72A that correspond to the scales 73A.

The control unit 27 forms the scale pattern 73 by controlling the first head 41, executing the going path printing or the returning path printing in which the first head 41 ejects the ink onto the medium M, and forming the scales 73A that are aligned in the transport direction Y.

The numbers of the scales 73A are formed of Arabic numbers from −5 to 5, increases toward the left side in the drawing, and decreases toward the right side in the drawing.

In a case in which dot formation positions in the going path and the returning path are the same, and the ink landing positions in the going path and the returning path do not deviate from each other, the line 72A of the second pattern 72 that corresponds to the number 0 (zero) is formed so as to overlap the first pattern 71.

In a case in which the dot formation positions in the going path and the returning path are different, and the ink landing positions in the going path and the returning path deviate from each other, the line 72A of the second pattern 72 that corresponds to the number 0 (zero) is not formed so as to overlap the first pattern 71, and the line 72A that corresponds to another number (another scale 73A) is arranged near the first pattern 71.

That is, it is possible to evaluate how much the ink landing positions deviate in the going path and the returning path depending on how large the scale 73A that corresponds to the line 72A arranged near the first pattern 71 is. In a case in which the line 72A that corresponds to the number 2 is arranged near the first pattern 71, for example, the ink landing positions in the going path and the returning path less deviate from each other as compared with a case in which the line 72A that corresponds to the number 4 is arranged near the first pattern 71. In a case in which the line 72A that corresponds to the number −4 is arranged near the first pattern 71, the ink landing positions in the going path and the returning path greatly deviate from each other as compared with a case in which the line 72A that corresponds to the number −2 is arranged near the first pattern 71.

Furthermore, the printing apparatus 210 registers adjustment values for causing the ink landing position in the going path printing and the ink landing position in the returning path printing, which correspond to the respective scales 73A of the scale pattern 73. That is, the printing apparatus 210 registers adjustment values for the Bi-d adjustment that correspond to the respective scales 73A of the scale pattern 73.

The user reads the scale 73A that corresponds to the line 72A that is located at the closest position to the first pattern 71 from the adjustment pattern 70. In the example in FIG. 9, the scale 73A that corresponds to the line 72A that is located at the closest position to the first pattern 71 is the number 2. Therefore, the user acquires the number 2 that corresponds to the line 72A that is located at the closest position to the first pattern 71 and inputs the number 2 to the printing apparatus 210. Then, the printing apparatus 210 adjusts the ejection timing of the ink by the first head 41 in the going path and the returning path depending on the adjustment value registered for the number 2 and performs the Bi-d adjustment for eliminating the actual positional deviation ΔG1 to zero.

Since the first pattern 71 is located between the line 72A that corresponds to the number 2 and the line 72A that corresponds to the number 3, the dot formation position in the going path printing and the dot formation position in the returning path printing can be arranged in such a level that is high enough for actual use even in a case in which the user determines (reads) that the scale 73A that corresponds to the line 72A near the first pattern 71 is number 3 and inputs the number 3 to the printing apparatus 210, and the Bi-d adjustment is performed with the adjustment value registered for the number 3.

Furthermore, the same Bi-d adjustment is also performed on the second head 42 with the adjustment pattern 70.

Medium Feeding Adjustment

Next, the medium feeding adjustment using the adjustment pattern 80 will be described.

The adjustment pattern 80 for the medium feeding adjustment shown in FIG. 10 has the same configuration as that of the adjustment pattern 70 (see FIG. 9) for the Bi-d adjustment.

That is, a first pattern 81 of the adjustment pattern 80 corresponds to the first pattern 71 of the adjustment pattern 70. A second pattern 82 of the adjustment pattern 80 corresponds to the second pattern 72 of the adjustment pattern 70. A scale pattern 83 of the adjustment pattern 80 corresponds to the scale pattern 73 of the adjustment pattern 70.

In contrast, a direction in which the components (the first pattern 81 and the second pattern 82) of the adjustment pattern 80 for the medium feeding adjustment extend is different from a direction in which the components (the first pattern 71 and the second pattern 72) of the adjustment pattern 70 for the Bi-d adjustment extend. This is a difference between the adjustment pattern 80 for the medium feeding adjustment and the adjustment pattern 70 for the Bi-d adjustment.

Next, an outline of the medium feeding adjustment of the head unit 40 (heads 41 and 42), mainly differences from the Bi-d adjustment of the heads 41 and 42 will be described. Also, the description of overlapping content will not be repeated.

The medium feeding adjustment of the head unit 40 is performed by using the adjustment pattern 80 that is formed by the ink ejected from the first head 41 and the second head 42. In the following description, the adjustment pattern 80 for the medium feeding adjustment of the head unit 40 is assumed to be formed by the ink ejected from the first head 41.

As shown in FIG. 10, the adjustment pattern 80 for the medium feeding adjustment has the first pattern 81 that is formed in the main-scanning direction X, the scale pattern 83 in which a plurality of scales 83A formed in the main-scanning direction X are aligned, and the second pattern 82 that is formed at a position corresponding to the scales 83A of the scale pattern 83 in the main-scanning direction X while changing the position thereof in a direction (transport direction Y) that intersects the main-scanning direction X.

In the adjustment pattern 80, the main-scanning direction X in which the first pattern 81 extends is an example of the "first direction", and the direction (transport direction Y) that intersects the main-scanning direction X is an example of the "second direction".

The first pattern 81 is a continuous line in the main-scanning direction X.

The second pattern 82 includes a plurality of lines 82A formed in the main-scanning direction X while changing the positions thereof in the transport direction Y and the main-scanning direction X. That is, the second pattern 82 includes the plurality of lines 82A that are aligned in a direction (oblique direction) that intersects the transport direction Y and the main-scanning direction X.

First, the control unit 27 controls the first head 41, executes going path printing in which the first head 41 ejects the ink onto the medium M, and forms the first pattern 81 and the scale pattern 83 (the plurality of scales 83A).

Next, the control unit 27 controls the first head 41, performs linefeed (sub-scanning) in which the first head 41 is relatively moved by an amount of linefeed Δy with respect to the medium M, and arranges the first head 41 at the next main scanning start position (the start position of the returning path printing). Specifically, the first head 41 and the medium M are relatively moved by transporting the medium M in the transport direction Y.

Finally, the control unit 27 controls the first head 41, executes the returning path printing in which the first head 41 ejects the ink onto the medium M, forms the lines 82A that correspond to the plurality of respective scales 83A while changing the positions thereof in the direction (transport direction Y) that intersects the main-scanning direction X, and forms the second pattern 82 that is formed of the plurality of lines 82A.

As described above, the control unit 27 forms the adjustment pattern 80 including the first pattern 81 that is formed in the main-scanning direction X, the plurality of scales 83A that are formed in the main-scanning direction X, and the second pattern 82 that is formed at the position corresponding to the scales 83A in the main-scanning direction X while changing the position the position thereof in the direction (transport direction Y) that intersects the main-scanning direction X by causing the ink ejected from the first head 41 to land on the same pixel array in the going path printing and the returning path printing by performing the going path printing, the linefeed, and the returning path printing.

In other words, the transport unit 30 transports the medium M in the transport direction Y, and the control unit 27 forms, as the adjustment pattern 80, the pattern for adjusting the amount of transport of the medium M.

The scales 83A are formed so as to correspond to the respective lines 82A that form the second pattern 82. In the embodiment, the scales 83A are arranged on the upper side with respect to the lines 82A that form the second pattern 82. That is, the scales 83A that are arranged on the upper side with respect to the lines 82A that form the second pattern 82 in FIG. 10 are the scales 83A that correspond to the lines 82A. Also, the lines 82A that are arranged on the lower side with respect to the scales 83A in FIG. 10 are the lines 82A that correspond to the scales 83A.

In a case in which the type of the medium M is changed and the transport distance of the medium M in the transport direction Y does not change and is maintained to be constant, that is, in a case in which the amount of linefeed Δy in the linefeed (sub-scanning) does not change, the line 82A of the second pattern 82 that corresponds to the number 0 (zero) is formed so as to overlap the first pattern 81.

In a case in which the type of the medium M is changed and the amount of linefeed Δy in the linefeed (sub-scanning) is changed, the line 82A of the second pattern 82 that corresponds to the number 0 (zero) is not formed so as to overlap the first pattern 81, and the line 82A of the second pattern 82 that corresponds to another scale 83A is arranged near the first pattern 81.

That is, it is possible to evaluate the amount of change in the amount of linefeed Δy in the linefeed (sub-scanning) depending on how large the scale 83A that corresponds to the line 82A arranged near the first pattern 81 is. In a case in which the number 82A that corresponds to the number 2 is arranged near the first pattern 81, for example, the amount of change in the amount of linefeed Δy decreases as compared with a case in which the line 82A that corresponds to the number 4 is arranged near the first pattern 81. In a case in which the line 82A that corresponds to the number −2 is arranged near the first pattern 81, for example, the amount of change in the amount of linefeed Δy decreases as compared with a case in which the line 82A that corresponds to the number −4 is arranged near the first pattern 81.

Furthermore, the printing apparatus 210 registers adjustment values for eliminating the amount of change in the amount of linefeed Δy to zero so as to correspond to the respective scales 83A of the scale pattern 83.

The user reads the scale 83A that corresponds to the line 82A that is located at the closest position to the first pattern 81 from the adjustment pattern 80. In the example in FIG. 10, the scale 83A that corresponds to the line 82A that is located at the closest position to the first pattern 81 is the number 2. Therefore, the user acquires the number 2 that corresponds to the line 82A that is located at the closest position to the first pattern 81 and inputs the number 2 to the printing apparatus 210. Then, the printing apparatus 210 performs the medium feeding adjustment for eliminating the amount of change in the amount of linefeed Δy depending on the adjustment value registered for the number 2.

Since the first pattern 81 is located between the line 82A that corresponds to the number 2 and the line 82A that corresponds to the number 3, it is possible to suppress banding at a boundary between an image formed by the going path printing and an image formed by the returning path printing to such a level that is high enough for actual use even in a case in which the user determines (reads) that the scale 83A of the scale pattern 83 near the first pattern 81 is the number 3 and inputs the number 3 to the printing apparatus 210 and the medium feeding adjustment is performed with the adjustment value registered for the number 3.

Next, effects of the adjustment patterns 70 and 80 according to the embodiment will be described.

The adjustment patterns 70 and 80 according to the embodiment are formed of pairs of the first patterns 71 and 81 and the second patterns 72 and 82 and the plurality of scales 73A and 83A, and the printing apparatus 210 registers the plurality of different values (the adjustment values for the Bi-d adjustment and the adjustment values for the medium feeding adjustment) so as to correspond to the plurality of respective scales 73A and 83A. That is, the adjustment patterns 70 and 80 are configured so as to be able to acquire the adjustment values (proper adjustment values for the Bi-d adjustment and proper adjustment values for the medium feeding adjustment) from the pairs of the first patterns 71 and 81 and the second patterns 72 and 82. In addition, the proper adjustment values for the Bi-d adjustment or the proper adjustment values for the medium feeding adjustment are acquired from the scales 73A and 83A that correspond to the second patterns 72 and 82 that are located near the first patterns 71 and 81.

Therefore, it is only necessary to inspect the scales 73A and 83A that correspond to the second patterns 72 and 82 that are located near the first patterns 71 and 81, and it is not necessary to inspect other extra scales 73A and 83A that correspond to the second patterns 72 and 82 that are not located near the first patterns 71 and 81. Therefore, it is possible to acquire the proper adjustment values in shorter time and to achieve higher efficiency in the operations as compared with a case in which other extra scales 73A and 83A are also inspected.

Furthermore, it is possible to acquire the proper adjustment values for the Bi-d adjustment or the medium feeding adjustment with one adjustment pattern 70 or one adjustment pattern 80, and to thereby reduce the number of adjustment patterns that are formed on the medium M and to reduce the space for the adjustment patterns that are formed on the medium M as compared with a case in which the plurality of adjustment patterns are used for the inspection, for example, in the embodiment. In addition, it is possible to reduce the amount of consumable supplies (for example, the ink, the medium M, and the like) used for forming the adjustment pattern and to reduce the cost of the adjustment pattern.

The effects such as the efficiency of the operations, the saving of the space for the adjustment pattern, the reduction in the cost of the adjustment pattern are exhibited more significantly in a case in which the head unit 40 has a lot of heads, a case in which the plurality of head units 40 are provided, and the like.

Embodiment 3

Figure 11:
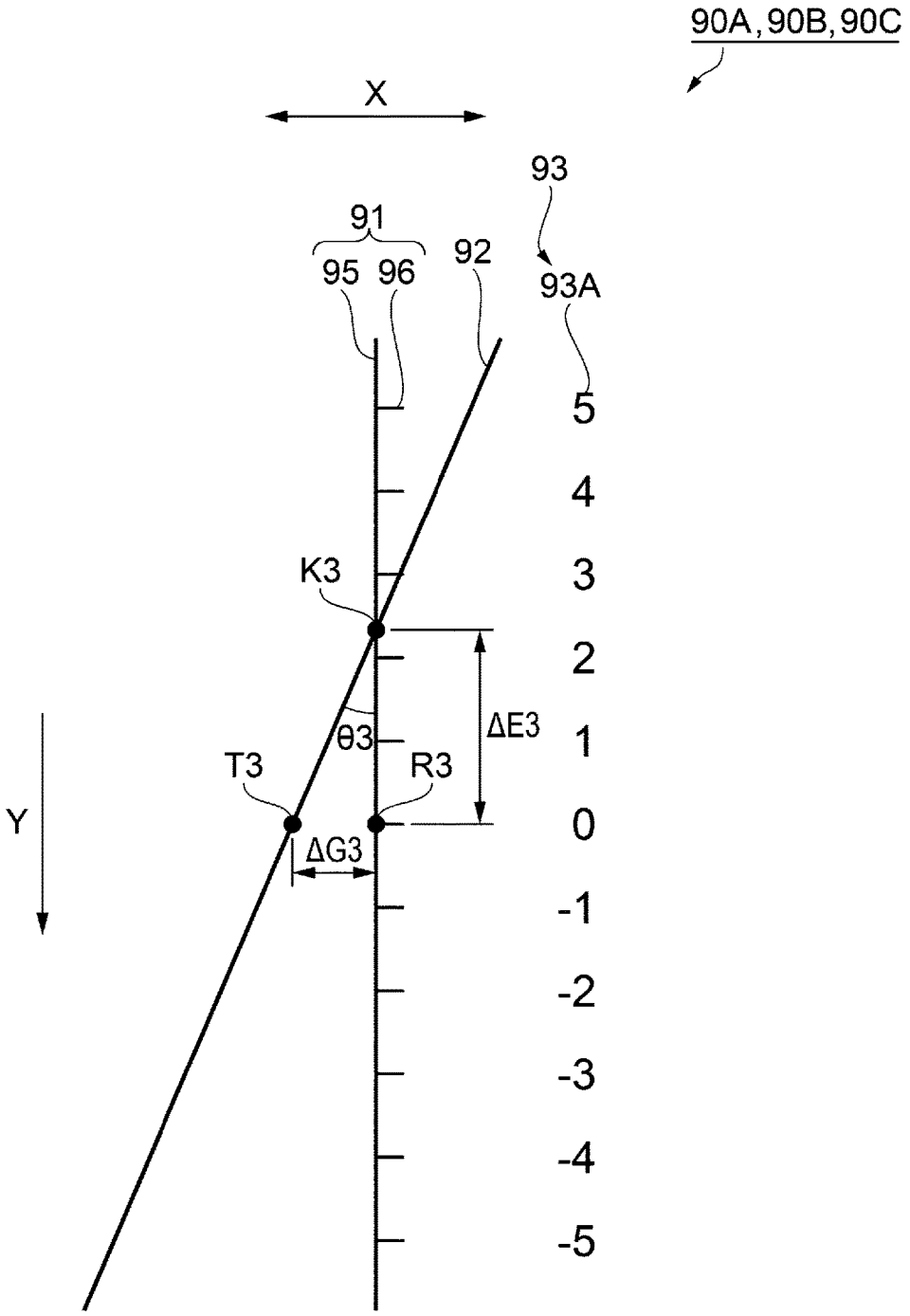
FIG. 11 is an outline diagram of an adjustment pattern for Uni-d adjustment according to Embodiment 3.

FIG. 11 is an outline diagram of an adjustment pattern for uni-direction (Uni-d) adjustment according to Embodiment 3.

A printing apparatus 310 according to the embodiment has the same configuration as that of the printing apparatus 10 according to Embodiment 1. In addition, the printing apparatus 310 according to the embodiment can perform uni-directional printing for one of a going path or a returning path (a going path, for example) in addition to the bi-directional printing for both the going path and the returning path.

Hereinafter, an outline of the embodiment, mainly differences from Embodiment 1 will be described. The same reference numerals will be given to the same components as those in Embodiment 1, and the description thereof will not be repeated.

The printing apparatus 310 according to the embodiment performs the uni-directional printing (uni-d printing) by repeating going path printing of performing main-scanning in which a head unit 40 (heads 41 and 42) is moved in one main-scanning direction X and linefeed (sub-scanning) in which the head unit 40 is relatively moved by the amount of linefeed Δy with respect to the medium M. Specifically, the first head 41 and the medium M are relatively moved by transporting the medium M in the transport direction Y.

In the uni-d printing, it is necessary to cause a landing position of a cyan (C) ink that is ejected from a nozzle #n in a nozzle array 36C, a landing position of magenta (M) ink that is ejected from a nozzle #n in a nozzle array 36M, a landing position of a yellow (Y) ink that is ejected from a nozzle #n in a nozzle array 36Y, and a landing position of black (K) ink that is ejected from a nozzle #n in a nozzle array 36K to coincide with each other for each of the first head 41 and the second head 42.

That is, it is necessary to cause the landing positions of the ink that is ejected from the nozzles 37 in the respective nozzle arrays 36C, 36M, 36Y, and 36K to coincide with each other such that a dot that is formed by the nozzle array 36C for ejecting the cyan (C) ink, a dot that is formed by the nozzle array 36M for ejecting the magenta (M) ink, a dot that is formed by the nozzle array 36Y for ejecting the yellow (Y) ink, and a dot that is formed by the nozzle array 36K for ejecting the black (K) ink are arranged in the same pixel array for each of the first head 41 and the second head 42 in the uni-d printing.

In a case in which the landing position of the cyan (C) ink that is ejected from the nozzle #n in the nozzle array 36C, the landing position of the magenta (M) ink that is ejected from the nozzle #n in the nozzle array 36M, the landing position of the yellow (Y) ink that is ejected from the nozzle #n in the nozzle array 36Y, and the landing position of the black (K) ink that is ejected from the nozzle #n in the nozzle array 36K are not arranged in the same pixel array, there is a concern that streak or color irregularity in the main-scanning direction X occurs or an image with a different color tone is formed.

Therefore, the printing apparatus 310 according to the embodiment performs the uni-d adjustment in which the landing positions of the ink ejected from the nozzles 37 in the respective nozzle arrays 36C, 36M, 36Y, and 36K are made to coincide with each other. That is, ink ejection timing is adjusted in each of the first head 41 and the second head 42 such that the ink landing position on the going path of a reference nozzle array (the nozzle array 36C, for example) coincides with the ink landing positions on the going paths of the other nozzle arrays (the nozzle arrays 36M, 36Y, and 36K, for example) in the uni-d adjustment.

Uni-d Adjustment

FIG. 11 is an outline diagram of an adjustment pattern for uni-d adjustment.

An adjustment pattern 90A for the uni-d adjustment shown in FIG. 11 has the same configuration as that of the adjustment pattern 50 (see FIG. 3) according to Embodiment 1.

That is, a first pattern 91 of the adjustment pattern 90A corresponds to the first pattern 51 of the adjustment pattern 50. A second pattern 92 of the adjustment pattern 90A corresponds to the second pattern 52 of the adjustment pattern 50. A scale pattern 93 of the adjustment pattern 90A corresponds to the scale pattern 53 of the adjustment pattern 50. A reference point R3 of the adjustment pattern 90A corresponds to the reference point R1 of the adjustment pattern 50. An adjustment point T3 of the adjustment pattern 90A corresponds to the adjustment point T1 of the adjustment pattern 50. An intersecting point K3 of the adjustment pattern 90A corresponds to the intersecting point K1 of the adjustment pattern 50. An intersecting angle θ3 of the adjustment pattern 90A corresponds to the intersecting angle θ1 of the adjustment pattern 50. An actual positional deviation ΔG3 of the adjustment pattern 90A corresponds to the actual positional deviation ΔG1 of the adjustment pattern 50. A length ΔE3 of a line segment K3R3 of the adjustment pattern 90A corresponds to the length ΔE1 of the line segment K1R1 of the adjustment pattern 50.

Hereinafter, an outline of the Uni-d adjustment of the heads 41 and 42, mainly differences from Embodiment 1 will be described with reference to FIG. 11. Description of the content that overlaps Embodiment 1 will not be repeated.

The uni-d adjustment is performed on each of the first head 41 and the second head 42, and the uni-d adjustment performed on the first head 41 is the same as the uni-d adjustment performed on the second head 42. Therefore, the uni-d adjustment performed on the first head 41 will be described below, and description of the uni-d adjustment performed on the second head 42 will be omitted.

As shown in FIG. 11, the adjustment pattern 90A for the uni-d adjustment of the first head 41 has the first pattern 91 that is formed in the transport direction Y, the scale pattern 93 in which the plurality of scales 93A formed in the transport direction Y are aligned, and the second pattern 92 that is formed at the position corresponding to the scales 93A of the scale pattern 93 in the transport direction Y while changing the position thereof in the direction (main-scanning direction X) that intersects the transport direction Y. That is, the adjustment pattern 90A for the uni-d adjustment is formed of the pair of the first pattern 91 and the second pattern 92 and the scale pattern 93.

In the adjustment pattern 90A, the transport direction Y in which the first pattern 91 extends is an example of the "first direction", and the direction (main-scanning direction X) that intersects the transport direction Y is an example of the "second direction".

The adjustment pattern 90A is formed by a process of forming the first pattern 91 and the scale pattern 93 (Step S21) and a process of forming the second pattern 92 (Step S22).

In Step S21, the control unit 27 controls the first head 41, executes the going path printing of ejecting the ink from the nozzle array 36C for ejecting the cyan (C) ink of the first head 41, and forms the scale pattern 93 including the first pattern 91 in the transport direction Y and the plurality of scales 93A aligned in the transport direction Y. Furthermore, the control unit 27 moves the first head 41 to an original position so as to execute the next going path printing.

In Step S22, the control unit 27 controls the first head 41, executes the going path printing of ejecting the ink from the nozzle array 36M for ejecting the magenta (M) ink of the first head 41, and forms the second pattern 92 that is formed at the position corresponding to the scales 93A of the scale pattern 93 in the transport direction Y while changing the position thereof in the direction (main-scanning direction X) that intersects the transport direction Y. That is, in Step S22, the control unit 27 controls the first head 41 and forms the second pattern 92 as the continuous line that intersects the first pattern 91 by using the nozzle array 36M that is different from the nozzle array 36C for forming the first pattern 91.

In the method of forming the adjustment pattern 90A, the linefeed (sub-scanning) of relatively moving the first head 41 by the amount of linefeed Δy with respect to the medium M is not performed between the going path printing (Step S21) and the next going path printing (Step S22). The control unit 27 forms the adjustment pattern 90A for the uni-d adjustment of the first head 41 in Steps S21 and S22. That is, the control unit 27 forms the adjustment pattern 90A for causing the landing position of the ink from the nozzle array 36M to coincide with the landing position of the ink from the nozzle array 36C.

In the adjustment pattern 90A, the first pattern 91 is formed by the nozzle array 36C for ejecting the cyan (C) ink, and the second pattern 92 is formed by the nozzle array 36M for ejecting the magenta (M) ink.

In the uni-d adjustment using the adjustment pattern 90A, the nozzle array 36C for ejecting the cyan (C) ink is assumed to be the reference nozzle array, and the landing position of the ink from the nozzle array 36M for ejecting the magenta (M) ink is made to coincide with the landing position of the ink from the reference nozzle array.

Specifically, the user reads the scale 93A of the scale pattern 93 that is located at the closest position to the intersecting point K3 from the adjustment pattern 90A. That is, since the scale 93A of the scale pattern 93 that is located at the closest position to the intersecting point K3 is the number 2, the user acquires the number 2 that is located at the closest position to the intersecting point K3 from the adjustment pattern 90A and inputs the number 2 to the printing apparatus 310. Then, the printing apparatus 310 adjusts ejection timing of the ink from the nozzle array 36M for ejecting the magenta (M) ink depending on an adjustment value registered for the number 2 and causes the landing position of the ink from the nozzle array 36M for ejecting the magenta (M) ink to coincide with the landing position of the ink from the nozzle array 36C for ejecting the cyan (C) INK.

Next, an adjustment pattern 90B including a first pattern 91 that is formed by the nozzle array 36C for ejecting the cyan (C) ink and a second pattern 92 that is formed by the nozzle array 36Y for ejecting the yellow (Y) ink is formed, and a landing position of ink from the nozzle array 36Y for ejecting the yellow (Y) ink is made to coincide with a landing position of ink from the nozzle array 36C for ejecting the cyan (C) ink by the uni-d adjustment using the adjustment pattern 90B.

Next, an adjustment pattern 90C including a first pattern 91 that is formed by the nozzle array 36C for ejecting the cyan (C) ink and a second pattern 92 that is formed by the nozzle array 36K for ejecting the black (K) ink is formed, and a landing position of ink from the nozzle array 36K for ejecting the black (K) ink is made to coincide with a landing position of ink from the nozzle array 36C for ejecting the cyan (C) ink by the uni-d adjustment using the adjustment pattern 90C.

Then, the uni-d adjustment of causing the landing positions of the ink ejected from the nozzle arrays 36C, 36M, 36Y, and 36K to coincide with each other is performed on the first head 41 by the aforementioned method.

Furthermore, the uni-d adjustment of causing the landing positions of the ink ejected from the nozzle arrays 36C, 36M, 36Y, and 36K to coincide with each other is also performed on the second head 42 by the same method as that for the first head 41.

Since the adjustment patterns 90A, 90B, and 90C for the uni-d adjustment according to the embodiment have the same configuration as that of the adjustment pattern 50 (see FIG. 3) according to Embodiment 1, the same effects as those of the adjustment pattern 50 according to Embodiment 1 can be obtained.

That is, since the intersecting angle θ3 is less than 45 degrees, the actual positional deviation ΔG3 is enlarged to the length ΔE3 of the line segment K3R3 that is longer than the actual positional deviation ΔG3 in the embodiment. Therefore, even in a case in which the positions of the reference point R3 as the ink landing position in the going path printing before the linefeed and the adjustment point T3 as the ink landing position in the going path printing after the linefeed is slightly different, the operator can easily visually evaluate the difference in the positions thereof and can easily obtain the proper adjustment value for the uni-d adjustment by observing the length ΔE3 of the line segment K3R3 (that is, the position of the intersecting point K3).

Therefore, if the adjustment value for the uni-d adjustment is acquired with the length ΔE3 of the line segment K3R3, it is possible to more easily acquire the proper adjustment value as compared with a case in which the adjustment value for the uni-d adjustment is acquired with the actual positional deviation ΔG3 and to thereby properly perform the uni-d adjustment.

Each of the adjustment patterns 90A, 90B, and 90C according to the embodiment is formed of the one pair of the first pattern 91 and the second pattern 92 and the plurality of scales 93A, and the printing apparatus 310 registers different adjustment values (adjustment values for the uni-d adjustment) so as to correspond to the plurality of respective scales 93A. That is, each of the adjustment patterns 90A, 90B, and 90C is configured so as to be able to acquire the adjustment values (the proper adjustment value for the uni-d adjustment) from the one pair of the first pattern 91 and the second pattern 92. Then, proper value for the uni-d adjustment is acquired from the scale 93A that is located near the intersecting point K3 between the first pattern 91 and the second pattern 92.

Therefore, it is only necessary to inspect the scale 93A that is located near the intersecting point K3 between the first pattern 91 and the second pattern 92, and it is not necessary to inspect other extra scales 93A that are not located near the intersecting point K3 between the first pattern 91 and the second pattern 92. Therefore, it is possible to acquire the proper adjustment value in shorter time and to achieve higher efficiency in the operations as compared with a case in which other extra scales 93A are also inspected.

Furthermore, according to the embodiment, it is possible to acquire the proper adjustment value for the uni-d adjustment with one of the adjustment patterns 90A, 90B, and 90C, and to thereby reduce the number of adjustment patterns formed on the medium M and to save the space for the adjustment patterns formed on the medium M as compared with a case in which a plurality of adjustment patterns are used for inspection, for example. In addition, it is possible to reduce the amount of consumable supplies (for example, the ink, the medium M, and the like) used to form the adjustment pattern and to reduce the cost of the adjustment pattern.

Furthermore, the aforementioned adjustment patterns 50, 60, 70, 80, 90A, 90B, and 90C are not limited to the applications to the printing apparatuses 10, 210, and 310 according to the aforementioned embodiments and may be applied to liquid ejecting apparatuses that spray or eject a fluid other than the ink (including a liquid form substance in which functional material particles are dispersed or mixed in a liquid, a fluid form substance such as a gel, and a sold that can be made to flow and can be ejected as a fluid) and perform recording.

For example, the aforementioned adjustment patterns 50, 60, 70, 80, 90A, 90B, and 90C may be applied to liquid form substance ejecting apparatuses that perform recording by ejecting liquid form substances including materials, such as electrode materials and color materials (pixel materials) used for manufacturing liquid crystal displays, electroluminescence (EL) displays, and surface emitting displays in a dispersed or melted manner, or may be applied to fluid form substance ejecting apparatuses that eject fluid form substances such as gels (physical gels, for example).

Furthermore, the aforementioned adjustment patterns 50, 60, 70, 80, 90A, 90B, and 90C may be applied to electronic devices other than the printing apparatuses 10, 210, and 310 according to the aforementioned embodiments, the aforementioned liquid form substance ejecting apparatuses, and the fluid form substance ejecting apparatuses. The electronic devices to which the aforementioned adjustment patterns 50, 60, 70, 80, 90A, 90B, and 90C are applied are included within the technical scope of the application.

This application claims priority under 35 U.S.C. § 119 to Japanese Patent Application No. 2017-006463, filed Jan. 18, 2017. The entire disclosure of Japanese Patent Application No. 2017-006463 is hereby incorporated herein by reference.

What is claimed is:

1. A liquid ejecting apparatus comprising:

an ejecting unit that ejects liquid onto a medium;

a transport unit that transports the medium; and a control unit that forms an adjustment pattern on the medium, wherein the control unit forms, as the adjustment pattern, a pattern including a first pattern that is formed in a first direction, a plurality of scales that are formed in the first direction, and a second pattern that is formed at a position corresponding to the scales in the first direction while changing the position thereof in a second direction that intersects the first direction.

2. The liquid ejecting apparatus according to claim 1, wherein the control unit forms, as the second pattern, a continuous line that intersects the first pattern.

3. The liquid ejecting apparatus according to claim 1, wherein the control unit forms, as the second pattern, a plurality of lines in the first direction while changing positions thereof in the first direction and the second direction.

4. The liquid ejecting apparatus according to claim 1, wherein the adjustment pattern is configured such that an adjustment value is able to be acquired from one pair of the first pattern and the second pattern.

5. The liquid ejecting apparatus according to claim 1, wherein the ejecting unit is configured to eject the liquid while moving in the second direction, and wherein the control unit forms, as the adjustment pattern, a pattern for adjusting ejection timing of the liquid by the ejecting unit.

6. The liquid ejecting apparatus according to claim 1, wherein the ejecting unit includes at least a first head and a second head, and wherein the control unit forms, as the adjustment pattern, a first adjustment pattern for adjusting ejection timing of the liquid from the first head and a second adjustment pattern for adjusting ejection timing of the liquid from the second head.

7. The liquid ejecting apparatus according to claim 1, wherein the transport unit transports the medium in the second direction, and wherein the control unit forms, as the adjustment pattern, a pattern for adjusting the amount of transport of the medium.

8. A method of forming an adjustment pattern by a liquid ejecting apparatus that includes an ejecting unit that ejects liquid onto a medium and a transport unit that transports the medium, the method comprising:

forming, as an adjustment pattern, a pattern including a first pattern that is formed in a first direction, a plurality of scales that are formed in the first direction, and a second pattern that is formed at a position corresponding to the scales in the first direction while changing the position thereof in a second direction that intersects the first direction.

* * * * *